US008247147B2

(12) United States Patent
Abe et al.

(10) Patent No.: US 8,247,147 B2
(45) Date of Patent: Aug. 21, 2012

(54) TONER

(75) Inventors: Koji Abe, Numazu (JP); Shinya Yachi, Mishima (JP); Satoshi Handa, Suntoh-gun (JP); Kazumi Yoshizaki, Suntoh-gun (JP); Emi Tosaka, Suntoh-gun (JP); Yasuhiro Hashimoto, Mishima (JP); Nobuhisa Abe, Susono (JP); Yushi Mikuriya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 30 days.

(21) Appl. No.: 11/767,640

(22) Filed: Jun. 25, 2007

(65) Prior Publication Data

US 2007/0259283 A1 Nov. 8, 2007

Related U.S. Application Data

(63) Continuation of application No. PCT/JP2006/326336, filed on Dec. 26, 2006.

(30) Foreign Application Priority Data

Mar. 3, 2006 (JP) ..... 2006-058186

(51) Int. Cl.
*G03G 9/087* (2006.01)

(52) U.S. Cl. ..... 430/109.3; 430/109.1; 430/109.4; 430/110.4; 430/137.15

(58) Field of Classification Search ..... 430/109.3, 430/109.4, 109.1, 110.4, 137.15
See application file for complete search history.

(56) References Cited

U.S. PATENT DOCUMENTS 5,352,649 A * 10/1994 Shibahashi et al. ..... 503/207
5,422,218 A 6/1995 Tong
5,489,498 A 2/1996 Ohno et al. ..... 430/110
5,712,974 A 1/1998 Gainey et al. ..... 395/200.1
5,716,746 A 2/1998 Mikuriya et al.
5,744,276 A 4/1998 Ohno et al. ..... 430/109
5,773,183 A 6/1998 Doujo et al.

(Continued)

FOREIGN PATENT DOCUMENTS

EP 0 772 093 A1 5/1997

(Continued)

OTHER PUBLICATIONS

Chinese Office Action issued in counterpart application No. 200680053692.X dated Sep. 7, 2010 along with the English-language translation (10 pages).

(Continued)

*Primary Examiner* — Mark F Huff
*Assistant Examiner* — Rachel Zhang
(74) *Attorney, Agent, or Firm* — Fitzpatrick, Cella, Harper & Scinto

(57) ABSTRACT

A toner including toner particles containing at least a binder resin and a colorant. The binder resin is a vinyl-based resin. The toner contains a THF insoluble matter in a quantity of 0.0 mass % or more to less than 16.0 mass %. The toner has a main peak in a molecular weight domain Dr1 ranging from 5,000 to 80,000 in measurement of THF soluble matter of the toner with a gel permeation chromatogram (GPC)-differential refractive index detector (RI), and the toner has a main peak in a molecular weight domain Dm1 ranging from 10,000 to 120,000 and at least one peak in a molecular weight domain Dm2 ranging from 300,000 to 7,000,000 in the GPC-RI measurement in measurement with a GPC-multi-angle laser light scattering detector (MALLS).

6 Claims, 3 Drawing Sheets

U.S. PATENT DOCUMENTS

| | | | | |
|---|---|---|---|---|
| 5,773,185 | A | 6/1998 | Yachi et al. | |
| 5,854,365 | A | 12/1998 | Ohno et al. | 526/228 |
| 5,942,366 | A | 8/1999 | Ohno et al. | 430/125 |
| 5,962,176 | A | 10/1999 | Ohno et al. | 430/109 |
| 6,632,577 | B2 | 10/2003 | Akashi et al. | |
| 6,756,175 | B2 | 6/2004 | Yamada et al. | |
| 7,029,813 | B2 | 4/2006 | Mikuriya et al. | 430/108.1 |
| 7,250,241 | B2 | 7/2007 | Ayaki et al. | |
| 7,374,848 | B2 | 5/2008 | Matsuoka et al. | |
| 2003/0027074 | A1 * | 2/2003 | Emoto et al. | 430/124 |
| 2003/0198883 | A1 * | 10/2003 | Hiratsuka et al. | 430/109.3 |
| 2004/0265721 | A1 * | 12/2004 | Matsuoka et al. | 430/109.4 |
| 2005/0026061 | A1 | 2/2005 | Mikuriya et al. | 430/108.1 |
| 2006/0240349 | A1 * | 10/2006 | Watanabe et al. | 430/108.4 |

FOREIGN PATENT DOCUMENTS

| | | | |
|---|---|---|---|
| EP | 1 566 703 | A2 | 8/2005 |
| JP | 06-273975 | | 9/1994 |
| JP | 07-092737 | | 4/1995 |
| JP | 7230188 | | 8/1995 |
| JP | 8044107 | | 2/1996 |
| JP | 08044110 | | 2/1996 |
| JP | 9006050 | | 1/1997 |
| JP | 10-90939 | A | 4/1998 |
| JP | 2002-202626 | | 7/2002 |
| JP | 2003-98875 | A | 4/2003 |
| JP | 2003-280270 | | 10/2003 |
| JP | 2004-4737 | A | 1/2004 |
| JP | 2004117912 | A * | 4/2004 |
| JP | 2004-184721 | A | 7/2004 |
| JP | 2005-37901 | A | 2/2005 |
| JP | 2005-062818 | | 3/2005 |
| JP | 2005-215271 | | 8/2005 |
| JP | 2005-266789 | A | 9/2005 |

OTHER PUBLICATIONS

Extended European Search Report dated Nov. 18, 2011 in European Application No. 06843709.4.

* cited by examiner

TONER

This application is a continuation of International Application No. PCT/JP2006/326336, filed Dec. 26, 2006, which claims the benefit of Japanese Patent Application No. 2006-058186, filed Mar. 3, 2006.

BACKGROUND OF THE INVENTION

1. Field of the Invention

The present invention relates to a toner for developing an electrostatic image in an image forming method such as electrophotography or electrostatic printing, or a toner according to a toner-jet mode.

2. Description of the Related Art

An image forming method involving visualizing an electrical or magnetic latent image on a recording body by using toner is employed for developing the latent image. A representative example of the image forming method is an electrophotographic method. The electrophotographic method involves: electrically forming a latent image on a photosensitive member by using various means; developing the latent image with toner to form a toner image; transferring the toner image onto a transfer material such as paper as required; and fixing the toner image to the transfer material by employing fixing means such as heating, pressurization, pressurization under heat, or solvent steam to provide an image.

A heat roller fixing method or a film fixing method involves causing a heat roller or a fixation film to pass a toner image on a sheet to be fixed while contacting the heat roller or the fixation film with the toner image to perform fixation. In each of the fixing methods, the surface of the heat roller or of the fixation film and toner on the sheet to be fixed contact with each other, so thermal efficiency upon fusion of the toner to the sheet to be fixed is extremely good. Accordingly, the fixing methods each enable fixation to be performed quickly, and each are extremely useful in an electrophotographic device. However, in each of the above fixing methods, the surface of the heat roller or of the fixation film contacts with the toner in a molten state, so part of the toner adheres to the surface of the heat roller or of the fixation film. As a result, an offset phenomenon in which the toner adhering to the surface of the heat roller or of the fixation film transfers to a next sheet to be fixed again occurs, so the sheet to be fixed is contaminated in some cases.

An additional improvement in toner performance such as fixability, offset resistance, or high durability is needed for coping with recent demands on reductions in size and weight, energy savings, and an improvement in reliability.

Japanese Patent Application Laid-Open No. 2003-280270 discloses a toner which: uses a polyester resin as a binder resin component; contains 5 to 30 mass % of THF insoluble matter; and specifies a relationship between an elution volume and light scattering intensity in the GPC-MALLS analysis of THF soluble matter obtained with a light scattering detector.

At present, however, an additional improvement in the low-temperature fixability of toner and gloss of the toner, the widening of the fixable temperature domain of the toner, and an additional improvement in development durability of the toner over a long time period have been required.

SUMMARY OF THE INVENTION

An object of the present invention is to provide a toner that has solved the above problems.

More specifically, an object of the present invention is to provide a toner which: is excellent in low-temperature fixability and offset resistance; has a wide fixing temperature range; provides a fixed image with high gloss at the time of fixation; and can form a toner image excellent in durability and having high quality.

The inventors of the present invention have made extensive studies. As a result, they have found that the following constitution can solve the above-mentioned problems. Specifically, they have found that a toner which: is excellent in low-temperature fixability and offset resistance; has a wide fixing temperature range; provides a fixed image having high gloss at the time of fixation; and is capable of forming a toner image excellent in durability and having high image quality can be obtained. Thus, they have completed the present invention.

That is, according to the present invention, there is provided a toner including toner particles containing at least a binder resin and a colorant, in which: the binder resin contains a vinyl-based resin as a main component; the toner contains a tetrahydrofuran (THF) insoluble matter in a content of 0.0 mass % or more to less than 16.0 mass % with respect to the binder resin of the toner; the toner has a main peak in a molecular weight domain Dr1 ranging from 5,000 to 80,000 in measurement of THF soluble matter of the toner with a gel permeation chromatogram (GPC)-differential refractive index detector (RI); and the toner has a main peak in a molecular weight domain Dm1 ranging from 10,000 to 120,000 and at least one peak in a molecular weight domain Dm2 ranging from 300,000 to 7,000,000 in the gel permeation chromatogram (GPC)-differential refractive index detector (RI) measurement in measurement with a gel permeation chromatogram (GPC)-multi-angle laser light scattering detector (MALLS).

According to the present invention, there can be provided a toner which: is excellent in low-temperature fixability and offset resistance; has a wide fixing temperature range; provides a fixed image having high gloss at the time of fixation; and is capable of forming a toner image excellent in durability and having high image quality.

Further features of the present invention will become apparent from the following description of exemplary embodiments with reference to the attached drawings.

DESCRIPTION OF THE EMBODIMENTS

Hereinafter, the present invention will be described in detail.

The incorporation of a large amount of a component in a low-molecular-weight domain is known to improve low-temperature fixability, and the incorporation of a large amount of a component in a high-molecular-weight domain is known to improve high-temperature offset resistance. A conventional technique has attempted to achieve compatibility between low-temperature fixability and high-temperature offset resistance by controlling a ratio between a component in a low-molecular-weight domain and a component in a high-molecular-weight domain.

In particular, in a high-molecular-weight domain, the incorporation of a small amount of a component having a high molecular weight is preferable because the incorporation improves high-temperature offset resistance and durability in development. However, low-temperature fixability becomes worse as the molecular weight becomes higher and the amount of a component in the high-molecular-weight domain becomes larger.

As a result, the segregation or separation of the component in a high-molecular-weight domain in toner is apt to occur, and the segregation or the separation is responsible for the deterioration of developability or of high-temperature offset resistance. Further, a toner material such as a wax or a colorant hardly enters the component in a high-molecular-weight domain that has segregated or separated without being uniformly mixed, with the result that developability is deteriorated.

As described above, the toner of the present invention is a toner having toner particles each containing at least a binder resin and a colorant. The toner contains as the main component of the binder resin a vinyl-based resin. The toner contains a tetrahydrofuran (THF) insoluble matter in a content of 0.0 mass % or more to less than 16.0 mass % with respect to the binder resin. The toner has a main peak in a molecular weight domain Dr1 ranging from 5,000 to 80,000 in the measurement of a tetrahydrofuran (THF) soluble matter of the toner with a gel permeation chromatogram (GPC)-differential refractive index detector (RI), and the toner has a main peak in a molecular weight domain Dm1 ranging from 10,000 to 120,000 and at least one peak in a molecular weight domain Dm2 ranging from 300,000 to 7,000,000 in the GPC-RI measurement in measurement with a GPC-multi-angle laser light scattering detector (MALLS). It should be noted that tetrahydrofuran, a gel permeation chromatogram-differential refractive index detector, and a gel permeation chromatogram-multi-angle laser light scattering detector may hereinafter be referred to as "THF", "GPC-RI", and "GPC-MALLS", respectively.

(Measurement of Molecular Weight Distribution with GPC-RI)

FIGS. 1 to 5 each show an example of a molecular weight distribution chart measured for the THF soluble matter of a preferable toner in the present invention.

Figure 1:
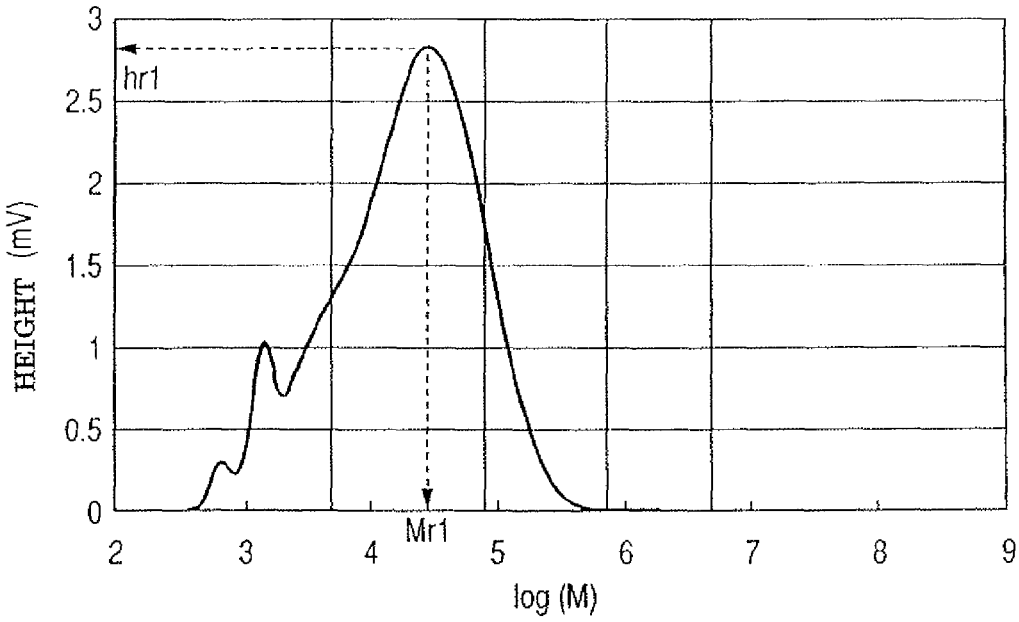
FIG. 1 is a view showing the molecular weight distribution chart of the THF soluble matter of a toner of the present invention measured with a GPC-RI.

FIG. 1 shows the molecular weight distribution chart of the THF soluble matter of the toner measured with a GPC-RI in which the molecular weight at which a main peak is present is represented by Mr1, and the height of the peak is represented by hr1 [mV]. In the molecular weight distribution chart of FIG. 1, the axis of abscissa indicates the common logarithm of a molecular weight M, and the axis of ordinate indicates a peak height (mV). A molecular weight domain ranging from 5,000 to 80,000 is represented by Dr1. The maximum height of peak in a molecular weight domain Dr2 ranging from 800,000 to 4,000,000 is represented by hr2 [mV], and the maximum height of peak in a molecular weight domain Dr3 of 4,000,000 or more is represented by hr3 [mV].

Figure 2:
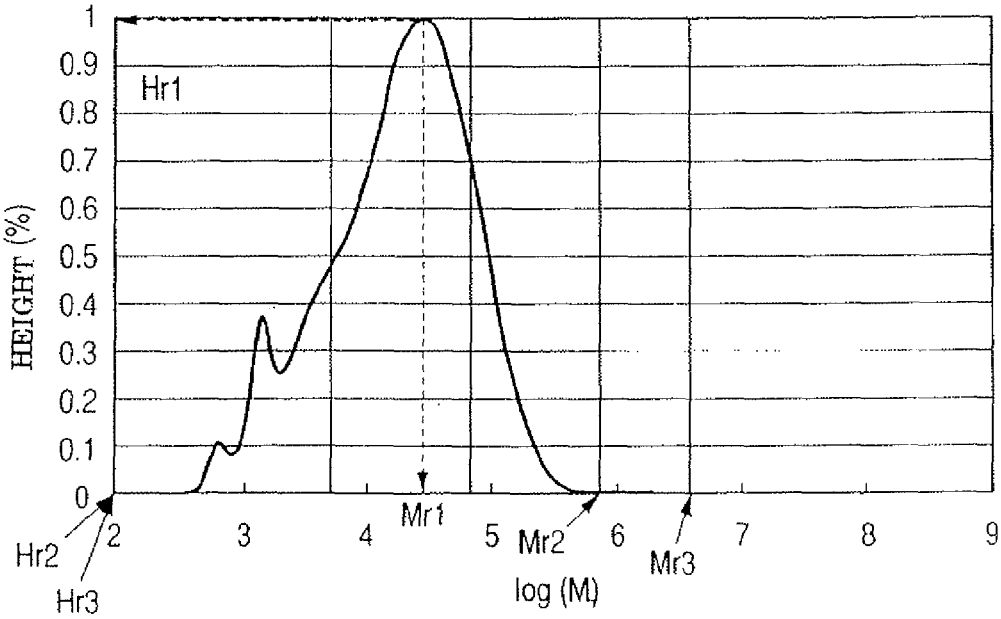
FIG. 2 is a view showing a molecular weight distribution chart obtained as a result of the conversion of the chart of FIG. 1 by setting a peak height hr1 [mV] equal to 1.00.

FIG. 2 shows a molecular weight distribution chart obtained as a result of the conversion of the molecular weight distribution chart shown in FIG. 1 of the THF soluble matter of the toner measured with a GPC-RI by setting the peak height hr1 [mV] equal to 1.00. Therefore, a peak height is represented in terms of % in FIG. 2.

In FIG. 2, the height of the main peak (the molecular weight at which the main peak is present is represented by Mr1) is represented by Hr1. The maximum height of peak in the domain Dr2 (the molecular weight corresponding to the maximum height of peak in the domain Dr2 is represented by Mr2) is represented by Hr2, and the maximum height of peak in the domain Dr3 (the molecular weight corresponding to the maximum height of peak in the domain Dr3 is represented by Mr3) is represented by Hr3. As shown in FIG. 2, the toner of the present invention has a main peak in the molecular weight domain Dr1 ranging from 5,000 to 80,000 in GPC-RI measurement.

Figure 3:
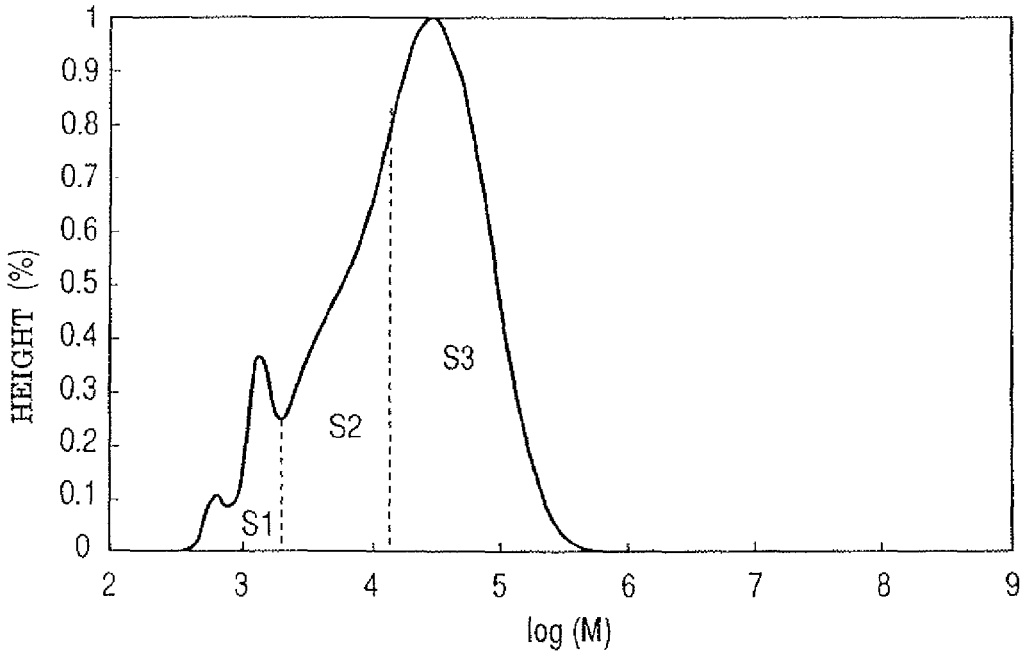
FIG. 3 is a view showing the integration values S1, S2, and S3 of three molecular weight domains in the chart of FIG. 2.

In addition, FIG. 3 shows the same molecular weight distribution chart as that of FIG. 2. The integration value of a molecular weight domain ranging from 300 to 2,000 is represented by S1, the integration value of a molecular weight domain ranging from 2,000 to 15,000 is represented by S2, and the integration value of a molecular weight domain ranging from 15,000 to 1,000,000 is represented by S3.

(Measurement of Molecular Weight Distribution with GPC-MALLS)

Figure 4:
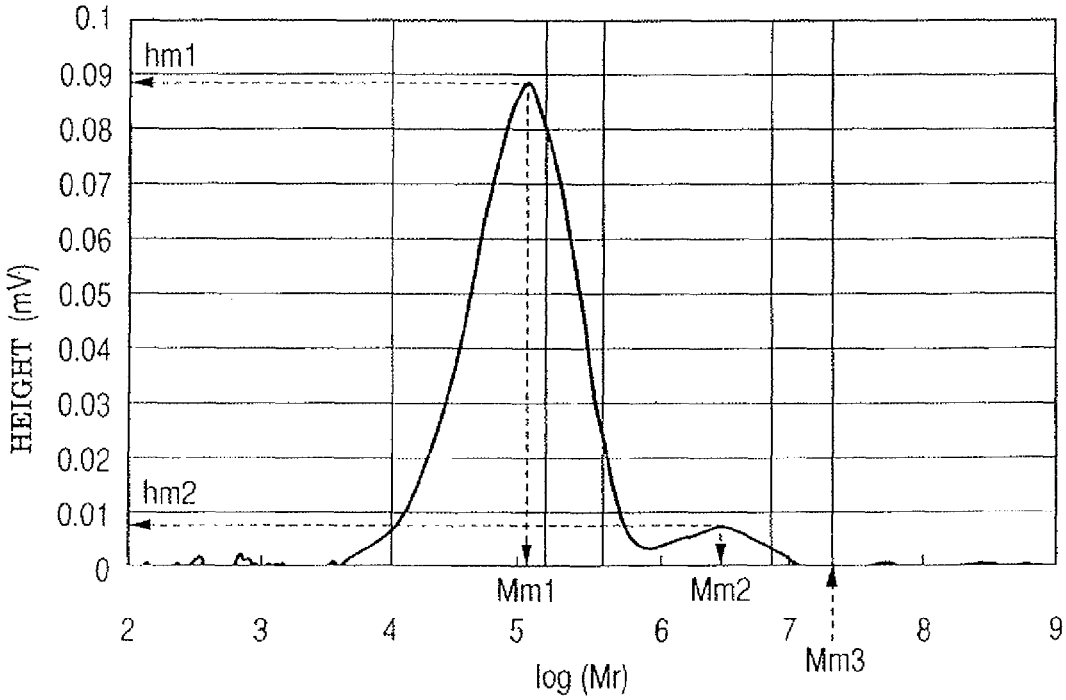
FIG. 4 is a view showing the molecular weight distribution chart of the THF soluble matter of the toner of the present invention measured with a GPC-MALLS.

FIG. 4 shows the molecular weight distribution chart of the THF soluble matter of the toner measured with a GPC-MALLS in which the axis of abscissa, retention time is represented in the common logarithm of a molecular weight determined from a standard polystyrene analytical curve obtained as a result of measurement with a GPC-RI, the molecular weight at which a main peak is present is represented by Mm1, and the height of the peak is represented by hm1 [mV]. In FIG. 4, Mr represents a molecular weight. Here, a molecular weight domain ranging from 10,000 to 120,000 is represented by Dm1. The maximum height of peak in a molecular weight domain Dm2 ranging from 300,000 to 7,000,000 (the molecular weight corresponding to the maximum height of peak in the domain Dm2 is represented by Mm2) is represented by hm2, and the maximum height of peak in a molecular weight domain Dm3 ranging from 7,000,000 to 20,000,000 (the molecular weight corresponding to the maximum height of peak in the domain Dm3 is represented by Mm3) is represented by hm3 (not shown).

Figure 5:
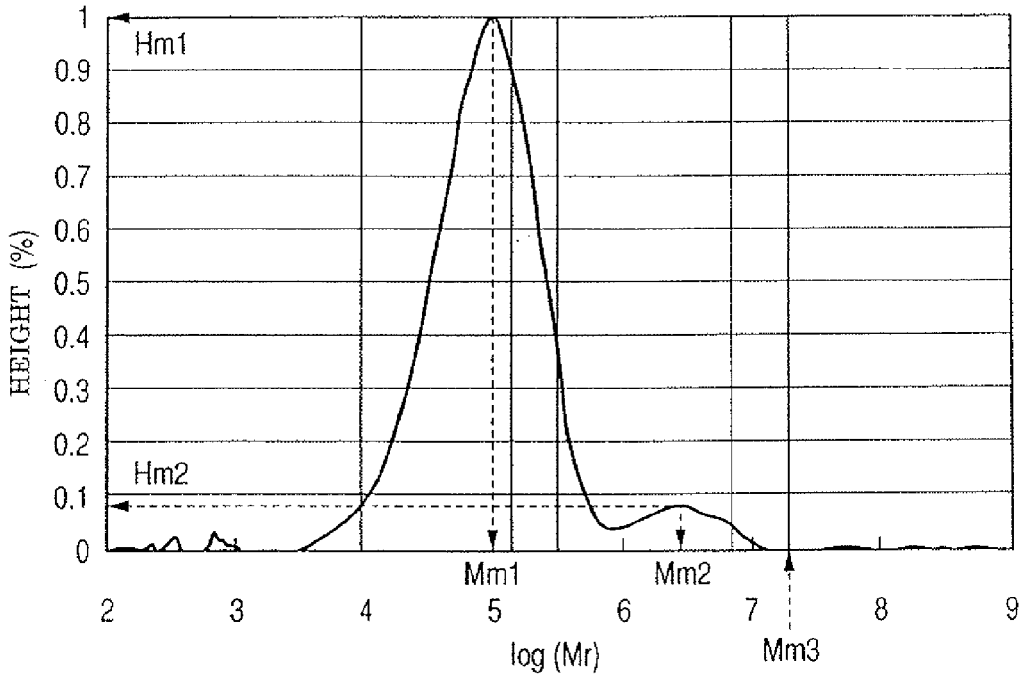
FIG. 5 is a view showing a molecular weight distribution chart obtained as a result of the conversion of the chart of FIG. 4 by setting a peak height hm1 [mV] equal to 1.00.

FIG. 5 shows a molecular weight distribution chart obtained as a result of the conversion of the molecular weight distribution chart shown in FIG. 4 of the THF soluble matter of the toner measured with a GPC-MALLS by setting the peak height hm1 [mV] equal to 1.00. Therefore, a peak height is represented in terms of % in FIG. 5.

In FIG. 5, the height of the main peak (the molecular weight at which the main peak is present is represented by Mm1) is represented by Hm1, and the maximum height of peak in the domain Dm2 (the molecular weight corresponding to the maximum height of peak in the domain Dm2 is represented by Mm2) is represented by Hm2. In addition, the maximum height of peak in the domain Dm3 (the molecular weight corresponding to the maximum height in the domain Dm3 is represented by Mm3) is represented by Hm3 (not shown). As shown in FIG. 4 or 5, the toner of the present invention has a main peak in the molecular weight domain Dm1 ranging from 10,000 to 120,000 and at least one peak in the molecular weight domain Dm2 ranging from 300,000 to 7,000,000 in the GPC-RI measurement.

A toner containing a component present in the domain Dr1 in the molecular weight distribution chart of the THF soluble matter of the toner measured with a GPC-RI and a component present in the domain Dm1 in the GPC-RI measurement in a molecular weight distribution chart measured with a GPC-MALLS has an effect on low-temperature fixability, and can provide an image having a low melt viscosity and high gloss.

Further, a component present in the domain Dm2 in the GPC-RI measurement in the molecular weight distribution chart measured with a GPC-MALLS shows a smaller viscosity change due to a temperature change than that of a wax present in the toner or of a polymer or copolymer having a molecular weight of less than 300,000 in the GPC-RI measurement. Accordingly, a toner containing a component present in the domain Dm2 in the GPC-RI measurement in the molecular weight distribution chart measured with a GPC-MALLS can provide a wide fixable temperature domain.

In the present invention, the toner has a main peak in the domain Dr1 in the molecular weight distribution chart of the THF soluble matter of the toner measured with a GPC-RI and a main peak in the domain Dm1 in the GPC-RI measurement in the molecular weight distribution chart measured with a GPC-MALLS, and the content of the THF insoluble matter is specified to be less than 16.0 mass %. As a result, components each having a specific molecular weight can be blended in a well-balanced manner. In particular, the toner contains components present in the domain Dr1 in a well-balanced manner, so the toner shows a quick viscosity reduction, and is excellent in adhesiveness to paper. In addition, the toner is excellent in releasing effect because the toner quickly exudes its wax. As a result, the toner exerts an excellent effect on low-temperature fixability. In addition, the toner contains components present in the domain Dm2 in the molecular weight distribution chart measured with a GPC-MALLS in a well-balanced manner, so the toner acts to improve an effect on the softening or exudation of a wax or of a polymer or copolymer having a molecular weight of less than 300,000. As a result, the toner exerts an excellent effect on low-temperature fixability, durability, and the widening of a fixable temperature domain.

In addition, the maximum height of peak (Hr2) in the molecular weight domain Dr2 ranging from 800,000 to 4,000,000 and the maximum height of peak (Hr3) in the molecular weight domain Dr3 of 4,000,000 or more in the measurement of the THF soluble matter of the toner of the present invention with the gel permeation chromatogram (GPC)-differential refractive index detector (RI) preferably satisfy the following expressions (1) and (2) with respect to the main peak height (Hr1):

$$0.00 \leqq (Hr2)/(Hr1) \leqq 0.30 \quad (1)$$

$$0.00 \leqq (Hr3)/(Hr1) \leqq 0.05 \quad (2).$$

When the ratio of Hr2 to Hr1 in the molecular weight distribution chart of the THF soluble matter of the toner measured with a GPC-RI is 0.30 or less, and the ratio of Hr3 to Hr1 in the chart is 0.05 or less, the toner exerts an excellent effect on low-temperature fixability and durability. In addition, a ratio of Hr2 to Hr1 in excess of 0.30 or a ratio of Hr3 to Hr1 in excess of 0.05 is not preferable because low-temperature fixability is apt to deteriorate. In particular, when the ratio of Hr2 to Hr1 is larger than 0.30, the amount of a low-molecular-weight component effective in improving gloss is small, and a viscosity change due to a temperature change is small, so gloss reduces in some cases. Further, when the ratio of Hr3 to Hr1 is larger than 0.05, a viscosity change due to a temperature change is small, so gloss reduces in some cases.

In addition, the maximum height of peak (Hm2) in the molecular weight domain Dm2 ranging from 300,000 to 7,000,000 and the maximum height of peak (Hm3) in the molecular weight domain Dm3 ranging from 7,000,000 to 20,000,000 in the GPC-RI measurement in the measurement of the toner of the present invention with the GPC-multi-angle laser light scattering detector (MALLS) preferably satisfy the following expressions (3) and (4) with respect to the main peak height (Hm1) in the domain Dm1:

$$0.050 \leqq (Hm2)/(Hm1) < 0.500 \quad (3)$$

$$0.000 \leqq (Hm3)/(Hm1) < 0.500 \quad (4).$$

When the ratio of Hm2 to Hm1 in the molecular weight distribution chart of the THF soluble matter of the toner measured with a GPC-MALLS is 0.050 or more and less than 0.500, and the ratio of Hm3 to Hm1 in the chart is less than 0.500, the toner exerts an excellent effect on low-temperature fixability and durability. When the ratio of Hm2 to Hm1 is less than 0.050, high-temperature offset resistance or durability reduces in some case. When the ratio of Hm2 to Hm1 is 0.500 or more, low-temperature fixability reduces in some cases. In addition, the ratio of Hm3 to Hm1 of 0.500 or more is not preferable because low-temperature fixability is apt to deteriorate.

In addition, in the present invention, the ratio S1:S2:S3 among the integration value (S1) of a molecular weight domain ranging from 300 to 2,000, the integration value (S2) of a molecular weight domain ranging from 2,000 to 15,000, and the integration value (S3) of a molecular weight domain ranging from 15,000 to 1,000,000 in the molecular weight distribution of the THF soluble matter in the toner measured by GPC is preferably (0.01 to 0.95):1.00:(1.00 to 8.00). When the ratio S1:S2:S3 is (0.01 to 0.95):1.00(1.00 to 8.00), additional improvements in low-temperature fixability, offset resistance, and gloss of a fixed image can be achieved because components are incorporated into the toner in a well-balanced manner.

When S1 is less than 0.01 or S3 exceeds 8.00 on condition that S2 is 1.00, low-temperature fixability deteriorates in some cases. In contrast, when S1 exceeds 0.95 or S3 is less than 1.00, offset resistance deteriorates in some cases.

In addition, it is preferable that: the endothermic chart of the toner of the present invention measured by differential scanning calorimetry (DSC) have an endothermic main peak in the range of 40 to 130° C.; and a heat quantity integration value Q represented by the peak area of the endothermic main peak be 10 to 35 J per 1 g of the toner.

As described above, it is preferable to constitute a toner having an endothermic main peak and having a main peak in a specific molecular weight domain in measurement with each of a GPC-RI and a GPC-MALLS. The constitution can provide a toner having good low-temperature fixability, good high-temperature offset resistance, and high durability. Of the constitutions specified in the present invention, the constitution in which the endothermic main peak is present in the range of 40 to 130° C., and the heat quantity integration value Q represented by the peak area of the endothermic main peak is 10 to 35 J per 1 g of the toner can cause the toner to show good releasability even at the time of low-temperature fixation. Further, when a wax is added to the toner, an intermolecular force between the polymer chains of the binder resin can be moderately alleviated, and a state where the softening of the toner due to heat absorption at the time of fixation and the curing of the resin due to the radiation of heat from the toner are proper can be established. The heat quantity integration value Q represented by the peak area of the endothermic main peak can be adjusted by appropriately selecting the kind, content, and the like of the wax. It should be noted that the endothermic main peak is present in the range of more preferably 50 to 110° C., or particularly preferably 60 to 90° C. In addition, the heat quantity integration value Q represented by the peak area of the endothermic main peak is more preferably 15 to 35 J per 1 g of the toner.

When the heat quantity integration value Q represented by the peak area of the endothermic main peak is less than 10 J per 1 g of the toner, fixability deteriorates, and the gloss of a fixed image is apt to reduce. In addition, the shaving or flaw of a fixing member or the like is hardly suppressed. On the other hand, when the heat quantity integration value Q represented by the peak area of the endothermic main peak exceeds 35 J per 1 g of the toner, the plastic effect of the wax becomes so large that offset resistance deteriorates in some cases.

Production methods for producing the toner of the present invention are preferably methods each involving directly producing toner in a medium such as a suspension polymerization method, an interfacial polymerization method, and a dispersion polymerization method (which may hereinafter be referred to as "polymerization methods"). A toner obtained by such polymerization method (which may hereinafter be referred to as "polymerization toner") has high transferrability because the shape of an individual toner particle is nearly spherical and a charge amount distribution is relatively even. Of the above polymerization methods, the suspension polymerization method is a particularly preferable production method for producing the toner of the present invention.

The suspension polymerization method will be described below.

The suspension polymerization method in the present invention is a polymerization method for producing toner particles, the method including at least: a granulating step involving dispersing a polymerizable monomer composition containing at least a polymerizable monomer, a colorant, and an addition-reactive resin having a double bond in an aqueous medium to produce a droplet of the polymerizable monomer composition; and a polymerizing step of polymerizing the polymerizable monomer in the droplet. As described below, a wax, a polar resin, and a low-molecular-weight resin can be added to the polymerizable monomer composition as desired. In addition, the weight average molecular weight (Mw) of the THF soluble matter of the low-molecular-weight resin determined by GPC is preferably 2,000 to 6,000 in terms of low-temperature fixability and blocking resistance.

In the toner of the present invention, a resin component may have a reactive functional group for the purpose of improving a viscosity change of the toner at high temperatures. Examples of the reactive functional group include a double bond and an isocyanate group.

In the method of producing toner of the present invention, a polar resin can be added into a polymerizable monomer composition before polymerization with a view to improving the shape of a toner particle, the dispersibility of materials, the fixability of toner, or image property. For example, when one wishes to introduce, into toner, a monomer component containing a hydrophilic functional group such as an amino group, a carboxylic group, a hydroxyl group, a sulfonic group, a glycidyl group, or a nitrile group, the component not being permitted to be used in an aqueous suspension because the component is water-soluble in a state of a monomer and dissolves in the suspension to cause emulsion polymerization, the monomer component can be used in the form of: a copolymer of the monomer component and a vinyl compound such as styrene or ethylene such as a random copolymer, a block copolymer, or a graft copolymer; a polycondensate such as polyester or polyamide; or an addition polymer such as polyether or polyimine.

Examples of a resin having a low-molecular-weight that can be added into a polymerizable monomer composition in addition to the foregoing include: homopolymers of styrene and a substituted product thereof such as polystyrene and polyvinyl toluene; styrene-based copolymers such as a styrene-propylene copolymer, a styrene-vinyl toluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-maleic acid copolymer, and a styrene-maleate ester copolymer; polymethyl methacrylate; polybutyl methacrylate; polyvinyl acetate; polyethylene; polypropylene; polyvinyl butyral; a silicone resin; a polyester resin; a polyamide resin; an epoxy resin; a polyacrylic resin; rhodine; modified rhodine; a terpene resin; a phenol resin; an aliphatic or alicyclic hydrocarbon resin; and an aromatic petroleum resin. One kind of them can be used alone, or two or more of them can be used in combination.

Of the low-molecular weight resins, a low-molecular weight resin having a glass transition point of 40 to 100° C. is preferable. When the glass transition point is lower than 40° C., the strength of the entire toner particles reduces, so a reduction in transferability or in development property is apt to occur at the time of an endurance test for many sheets. Further, the toner particles are apt to aggregate together under a high-temperature, high-humidity environment, so storage stability is apt to reduce. On the other hand, when the glass transition point exceeds 100° C., a problem referred to as fixation failure is apt to occur.

The glass transition point of the low-molecular weight resin is more preferably 40 to 70° C., or still more preferably 40 to 65° C. in terms of low-temperature fixability and the obtainment of a high-gloss image.

The amount of the low-molecular weight resin to be added preferably is 0.1 to 75 parts by mass in the binder resin of 100 parts by mass in each of the toner particles. When the amount of the low-molecular weight resin is less than 0.1 part by mass in the binder resin of 100 parts by mass in each of the toner particles, an effect of the addition of the low-molecular weight resin is small.

The toner of the present invention preferably contains an addition-reactive resin having a double bond. Therefore, upon production of the toner of the present invention, an addition-reactive resin having a double bond is preferably used. A styrene-based resin is a preferable addition-reactive resin having a double bond. For example, in a styrene resin produced by polymerization at a high temperature of 180° C. or higher, peaks each originating from a double bond are observed in the range of 4.6 to 4.9 ppm and the range of 5.0 to 5.2 ppm in $^{1}$H-NMR measurement using a heavy chloroform solvent. That is, an addition-reactive resin obtained as described above has double bonds, and these double bonds crosslink at the time of the production of toner particles. Thus, a small amount of a crosslinked structure is introduced into each toner particle, whereby the viscosity change rate of the toner at high temperatures can be additionally effectively reduced. Further, when the weight average molecular weight of the addition-reactive resin is 2,000 to 6,000, the resin has a higher molecular weight and milder reactivity than those of a low-molecular-weight crosslinking agent that has been conventionally used such as divinylbenzene. As a result, the resin slightly crosslinks, whereby a toner having a low viscosity and such a heat characteristic that a temperature-dependent viscosity change rate is small can be obtained.

The number average molecular weight of the above addition-reactive resin having a double bond is preferably 500 or more and less than 3,000. When the number average molecular weight of the addition-reactive resin is smaller than 500, large amounts of components each having a small molecular weight are present, and the storage stability of the toner deteriorates owing to the exudation of the components in some cases. In addition, when the number average molecular weight is larger than 3,000, low-temperature fixability reduces in some cases.

Examples of an addition-reactive resin that can be added into a polymerizable monomer composition in addition to the foregoing include: homopolymers of styrene and a substituted product thereof such as polystyrene and polyvinyl toluene; styrene-based copolymers such as a styrene-propylene copolymer, a styrene-vinyl toluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-maleic acid copolymer, and a styrene-maleate ester copolymer; polymethyl methacrylate; polybutyl methacrylate; polyvinyl acetate; polyethylene; polypropylene; polyvinyl butyral; a silicone resin; a polyester resin; a polyamide resin; an epoxy resin; a polyacrylic resin; rhodine; modified rhodine; a terpene resin; a phenol resin; an aliphatic or alicyclic hydrocarbon resin; and an aromatic petroleum resin. One kind of them can be used alone, or two or more of them can be used in combination.

The addition-reactive resin preferably has a glass transition point of 40 to 100° C. When the glass transition point is lower than 40° C., the strength of the entire toner particles reduces, so a reduction in transferability or in development property is apt to occur at the time of an endurance test for many sheets. Further, the toner particles are apt to aggregate together under a high-temperature, high-humidity environment, so there arises a problem in that storage stability reduces. On the other hand, when the glass transition point exceeds 100° C., a problem referred to as fixation failure is apt to occur.

The glass transition point of the addition reaction resin is preferably 40 to 70° C., or more preferably 40 to 65° C. in terms of low-temperature fixability and the obtainment of a high-gloss image.

The addition amount of the addition-reactive resin is preferably 0.1 to 75 parts by mass with respect to 100 parts by mass of the binder resin in the toner particles. When the addition amount is less than 0.1 part by mass with respect to 100 parts by mass of the binder resin in the toner particles, an effect of the addition of the addition-reactive resin is small.

The toner of the present invention is preferably a toner including at least toner particles each having at least a core portion and a shell portion and inorganic fine powder. The shell portion is present to cover the core portion in each of the toner particles. With such structure, charging failure or blocking due to the exudation of the core portion to the surface of a toner particle can be prevented under any environment. In addition, it is more preferable that a surface layer portion having contrast which is different from that of the shell portion be additionally present on the surface of the shell portion. The presence of the surface layer portion can additionally improve environmental stability, durability, and blocking resistance.

A material of which the surface layer portion is constituted preferably has a molecular chain polar structure. The term "molecular chain polar structure" as used herein refers to a molecular structure in which an atom in a molecule has a large number of $\delta^+$ or $\delta^-$ electron density states.

A resin molecule is constituted of multiple kinds of atoms. The atoms of which the molecule is constituted each have an inherent electronegativity, and values for electronegativities largely vary from atom to atom. An electron is localized in the molecule owing to the difference in electronegativity. The state of the localization at this time changes depending on the kinds and number of the atoms of which the molecule is constituted and on the manner in which the atoms are bound to each other, whereby the polarity of a molecular chain changes.

A bond structure formed by condensation polymerization or addition polymerization is a preferable example of the molecular chain polar structure. Specific examples of the bond structure include an ester bond (—COO—), an ether bond (—O—), an amide bond (—CONH—), an imine bond (—NH—), a urethane bond (—NHCOO—), and a urea bond (—NHCONH—).

For example, an ether chain ($—CH_2—O—CH_2—$) is in a state where electrons on a carbon atom are slightly deficient ($\delta^+$), electrons on an oxygen atom are slightly excessive ($\delta^-$), and, Further, a bond angle using the oxygen atom as an apex is produced. When a large number of molecular chains polarized in this way are present, the polarity of a molecule, that is, a resin increases. When the number of polarized molecular chains is small, the polarity of the resin reduces. In addition, in general, the polarity of a molecule composed of hydrocarbon is low.

Charging stability improves when the surface layer portion has a molecular chain polar structure. In addition, when the toner particles are produced in a polar solvent such as an aqueous or hydrophilic medium, the charging stability of the toner at high temperature and high humidity or at low temperature and low humidity, and the durability of the toner upon high-speed printing improve because the surface layer portion having a molecular chain polar structure is formed near the toner surface with improved uniformity.

The toner of the present invention preferably contains a polyester resin. A styrene-denatured polyester resin is preferably used as the polyester resin.

Examples of a surface layer portion to be particularly suitably used in the present invention include a polyester resin and a derivative of the resin.

A vinyl-based polymerizable monomer can be preferably included as a polymerizable monomer that can be used to produce the toner particles of the present invention. Examples of the polymerizable monomer include: styrene; styrene derivatives such as α-methylstyrene, β-methylstyrene, o-methylstyrene, m-methylstyrene,p-methylstyrene, 2,4-dimethylstyrene, p-n-butylstyrene, p-tert-butylstyrene, p-n-hexylstyrene, p-n-octyl styrene, p-n-nonylstyrene, p-n-decylstyrene, p-n-dodecylstyrene, p-methoxystyrene, and p-phenylstyrene; acrylic-based polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxy ethyl acrylate; methacryl-based polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; methylene aliphatic monocarboxylic acid esters; vinyl esters such as vinyl acetate, vinyl propionate, vinyl benzoate, vinyl butyrate, vinyl benzoate, and vinyl formate; vinyl ethers such as vinyl methyl ether, vinyl ethyl ether, and vinyl isobutyl ether; and vinyl ketones such as vinyl methyl ketone, vinyl hexyl ketone, and vinyl isopropyl ketone.

The shell portion of the toner of the present invention is constituted of any of vinyl-based polymers each formed of, or each added with, any of those vinyl-based polymerizable monomers. Of those vinyl-based polymers, a styrene polymer, or a styrene-acrylic copolymer or a styrene-methacrylic copolymer is preferable from the viewpoint of the efficient coverage of the wax of which the inside or central portion of the toner is mainly formed.

Wax is a preferable material of which the core portion of the toner of the present invention is constituted. Examples of a wax component that can be used in the toner according to the present invention include: petroleum-based waxes such as a paraffin wax, a microcrystalline wax, and petrolatum, and derivatives of the waxes; a montan wax and a derivative of the wax; a hydrocarbon wax according to a Fischer-Tropsch method and a derivative of the wax; polyolefin waxes such as polyethylene and polypropylene, and derivatives of the waxes; and natural waxes such as a carnauba wax and a candelilla wax, and derivatives of the waxes. The term "derivative" comprehends an oxide, a block copolymer with a vinyl-based monomer, and a graft-modified product. Further, any one of: higher aliphatic alcohols; aliphatic acids such as stearic acid and palmitic acid, and compounds of the acids; acid amide waxes; ester waxes; ketones; a hardened castor oil and a derivative of the oil; vegetable waxes; animal waxes; and a silicone resin can also be used.

Of the ester waxes, a compound having one or more long-chain ester parts each having 10 or more carbon atoms and each represented by any one of the following formulae (1) to (6) is particularly preferable because the transparency of an transparency film for an overhead projector (OHP film) is not inhibited:

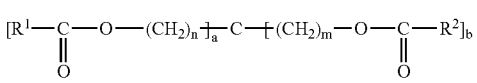

(1)

where a and b each represent an integer of 0 to 4, a+b=4, $R^1$ and $R^2$ each represent an organic group having 1 to 40 carbon atoms, n and m each represent an integer of 0 to 15, and n and m cannot simultaneously represent 0;

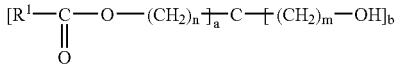

(2)

where a and b each represent an integer of 1 to 3, a+b=4, $R^1$ represents an organic group having 1 to 40 carbon atoms, n and m each represent an integer of 0 to 15, and n and m cannot simultaneously represent 0;

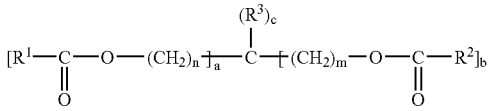

(3)

where a and b each represent an integer of 0 to 3, a+b=2 or 3, $R^1$ and $R^2$ each represent an organic group having 1 to 40 carbon atoms, in which a difference in carbon number between $R^1$ and $R^2$ is 10 or more, $R^3$ represents an organic group having one or more carbon atoms, c represents 2 or 1, a+b+c=4, n and m each represent an integer of 0 to 15, and n and m cannot simultaneously represent 0;

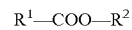

(4)

where $R^1$ and $R^2$ each represent a hydrocarbon group having 1 to 40 carbon atoms, and $R^1$ and $R^2$ may be identical to or different from each other in carbon number;

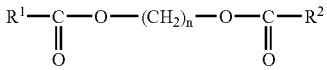

(5)

where $R^1$ and $R^2$ each represent a hydrocarbon group having 1 to 40 carbon atoms, n represents an integer of 2 to 20, and $R^1$ and $R^2$ may be identical to or different from each other in carbon number;

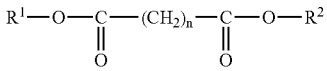

(6)

where $R^1$ and $R^2$ each represent a hydrocarbon group having 1 to 40 carbon atoms, n represents an integer of 2 to 20, and $R^1$ and $R^2$ may be identical to or different from each other in carbon number.

The weight average molecular weight (Mw) of the wax is preferably 300 to 1,500 or more preferably 400 to 1,250. When the weight average molecular weight is less than 300, the exudation of the wax to the surface of a toner particle is apt to occur. When the weight average molecular weight exceeds 1,500, low-temperature fixability may reduce. Further, when a ratio (Mw/Mn) of the weight average molecular weight to a number average molecular weight is 1.5 or less, the peak of the DSC endothermic curve of the wax becomes additionally sharp, the mechanical strength of a toner particle at room temperature improves, and sharp melt property is shown at the time of fixation. Thus, extremely excellent physical properties of the toner can be obtained.

Specific examples of the above-mentioned ester waxes include compounds represented by the following general formulae.

$$CH_3(CH_2)_{20}COO(CH_2)_{21}CH_3 \quad 1)$$

$$CH_3(CH_2)_{17}COO(CH_2)_9OOC(CH_2)_{17}CH_3 \quad 2)$$

$$CH_3(CH_2)_{17}OOC(CH_2)_{18}OOC(CH_2)_{17}CH_3 \quad 3)$$

There has been a growing need for full-color images on both surfaces in recent years. Upon formation of images on both surfaces, there is a possibility that a toner image on a transfer material which has been formed on the front surface of the material first passes the heating portion of a fixing unit again even at the time of the subsequent formation of an image on the rear surface of the material, so the high-temperature offset resistance of a fixed image provided by the toner at that time must be sufficiently taken into consideration. Specifically, the addition of 2 to 30 mass % of wax into a toner particle is a preferable. When the wax is added in an amount of less than 2 mass %, high-temperature offset resistance reduces, and, further, the image on a rear surface may show an offset phenomenon at the time of the fixation of images on both surfaces. When the wax is added in an amount in excess of 30 mass %, the coalescence of toner particles is apt to occur at the time of granulation in the production by a polymerization method, and a wide particle size distribution is apt to be produced.

The toner of the present invention preferably has an average circularity of 0.970 or more to 1.000 or less and a mode circularity of 0.98 or more to 1.00 or less. It should be noted that the average circularity and the mode circularity were each determined from a circle-equivalent diameter-circularity scatter gram on a number basis obtained by measuring toner particles each having a particle diameter of 2 μm or more with a flow-type particle image measuring device.

Here, the "circularity" in the present invention is used as a simple measure for quantitatively representing the shape of a particle. In the present invention, measurement is performed by using a flow-type particle image analyzer FPIA-2100 manufactured by SYSMEX CORPORATION, and a value determined from the following equation is defined as a circularity.

Circularity $a=L_0/L$ $L_0$: Circumferential length of a circle having the same projected area as that of a particle image L: Circumferential length of the particle image ($L_0$; Circumferential length of a circle having the same projected area as that of a particle image, L; Circumferential length of a projected image of a particle)

The circularity in the present invention is a measure of the degree of the irregularities of a toner particle. When a toner is of a completely spherical shape, the circularity is 1.00. The more complicated a surface shape, the lower the circularity.

Toner particles having an average circularity of 0.970 to 1.000 are preferable because they are extremely excellent in transferability. This is probably because the area of contact between toner and a photosensitive member is so small that a reduction in adhesive force of the toner to the photosensitive member resulting from, for example, an image force or a Van der Waals force occurs. Therefore, the use of such toner provides a high transfer rate and extremely reduces the amount of transfer residual toner, so the use probably provides the following effects: an extreme reduction in amount of toner at the portion at which a charging member and a photosensitive member are brought into press contact with each other; the prevention of toner fusion; and the significant suppression of an image defect.

Those effects occur with improved remarkableness in an image forming method including a contact transfer step in which a void during transfer is apt to occur.

The toner according to the present invention can be produced by a pulverization method. However, toner produced by the pulverization method is generally of an indeterminate form, and, in order that the toner may have an average circularity of 0.970 or more to 1.000 or less, a mechanical, thermal, or any other special treatment is needed in many cases.

In addition, the fact that a mode circularity is 0.98 or more to 1.00 or less in the circularity distribution of toner means that most of the toner particles each have a shape close to a true spherical shape. A mode circularity of 0.98 or more to 1.00 or less is preferable because a reduction in adhesive force of toner to a photosensitive member resulting from, for example, an image force or a Van der Waals force becomes additionally remarkable and transfer efficiency becomes extremely high.

Here, the mode circularity is defined as described below. Circularities in the range of 0.40 to 1.00 are divided into 61 ranges in an increment of 0.01 including the range from 0.40 (inclusive) to 0.41 (exclusive), the range from 0.41 (inclusive) to 0.42 (exclusive), the range from 0.99 (inclusive) to 1.00 (exclusive), and the range of 1.00. The circularities of the respective measured particles are assigned to the respective divisional ranges. The lower limit circularity of the divisional range where a frequency value becomes maximum in a circularity frequency distribution is defined as the mode circularity.

In the present invention, any of charge control agents is preferably added to each toner for the purpose of controlling the chargeability of the toner.

Of those charge control agents, a known charge control agent having substantially no polymerization inhibiting property and substantially no aqueous phase migration characteristic is preferable. Examples of a positive charge control agent include: a nigrosin-based dye; a triphenylmethane-based dye; a quaternary ammonium salt; a guanidine derivative; an imidazole derivative; and an amine-based compound. Examples of a negative charge control agent include: a metal-containing salicylic acid copolymer; a metal-containing monoazo-based dye compound; a urea derivative; a styrene-acrylic acid copolymer; and a styrene-methacrylic acid copolymer.

Each of those charge control agents is preferably added in an amount of 0.1 to 10 mass % with respect to the binder resin or the polymerizable monomer.

Examples of the polymerization initiator to be used upon production of toner particles by employing a polymerization method include: azo-based or diazo-based polymerization initiators such as 2,2'-azobis-(2,4-divaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide-based polymerization initiators such as benzoyl peroxide, methyl ethyl ketone peroxide, diisopropyl oxycarbonate, cumene hydroperoxide, 2,4-dichlorobenzoyl peroxide, and lauroyl peroxide. Those polymerization initiators are preferably added in an amount of 0.5 to 20 mass % with respect to a polymerizable monomer and one kind of them can be used alone, or two or more of them can be used in combination.

A preferable main component of the binder resin of toner particles is vinyl-based resins. The vinyl-based resins are preferably produced by polymerizing with the above-mentioned vinyl-based polymerizable monomer.

A chain transfer agent may be added for controlling the molecular weight of the binder resin of toner particles. The addition amount of the chain transfer agent is preferably 0.001 to 15 mass % with respect to the polymerizable monomer.

A crosslinking agent may be added for controlling the molecular weight of the binder resin of each of the toner particles. Examples of the crosslinking monomers to be used in the present invention include, as a bifunctional crosslinking agent, divinylbenzene, bis(4-acryloxypolyethoxyphenyl) propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400, and #600, dipropylene glycol diacrylate, polypropylene glycol diacrylate, polyester-type diacrylates (MANDA, Nippon Kayaku Co., Ltd.), and those obtained by changing the above-mentioned acylates to methacrylates.

Examples of the polyfunctional crosslinking monomers include pentaerythritol triacrylate, trimethylolethane triacrylate, trimethylolpropane triacrylate, tetramethylolmethane tetraacrylate, oligoester acrylate and methacrylate thereof, 2,2-bis(4-mathacryloxypolyethoxyphenyl)propane, diacrylphthalate, triallylcyanurate, triallylisocyanurate, triallyltrimelitate, and diallylchlorendate. An amount of those crosslinking agents to be added is preferably 0.001 to 15 mass % with respect to the polymerizable monomer.

In case of an aqueous dispersion medium, a fine powder made of an inorganic compound such as tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, or alumina may be added as a dispersion stabilizer for a particle of the polymerizable monomer composition.

In the present invention, in addition to the foregoing, various additives shown below can be added to the toner particles for the purpose of imparting various physical properties. Each of the additives preferably has a particle diameter equal to or less than one tenth of the weight average particle diameter of the toner particles in terms of durability upon addition to the toner particles. The term "particle diameter of an additive" means the average particle diameter of the additive determined as a result of the observation of the surface of each of the toner particles by using an electron microscope. Examples of the additives used for imparting those physical properties include the following.

(1) Fluidity imparting agents: Metal oxides (such as silica, alumina, and titanium oxide), carbon black, and carbon fluoride. Each of them is more preferably subjected to a hydrophobic treatment.

(2) Abrasives: Metal oxides (such as strontium titanate, cerium oxide, alumina, magnesium oxide, and chromium oxide), nitrides (such as silicon nitride), carbides (such as silicon carbide), and metal salts (such as calcium sulfate, barium sulfate, and calcium carbonate).

(3) Lubricants: Fluorine-based resin powders (made of, for example, vinylidene fluoride and polytetrafluoroethylene) and aliphatic acid metal salts (such as zinc stearate and calcium stearate).

(4) Charge controllable particles: Metal oxides (such as tin oxide, titanium oxide, zinc oxide, silica, and alumina) and carbon black.

These additives may preferably be used in an amount of 0.1 to 10.0 parts by mass, more preferably in amount of 0.1 to 5 parts by mass with respect to 100 parts by mass of the toner particles. The additives may be used alone or in a combination of two kinds or more.

In addition, the toner of the present invention has a weight average particle diameter D4 of preferably 2.0 to 12.0 μm, more preferably 4.0 to 9.0 μm, or still more preferably 5.0 to 8.0 μm.

The toner of the present invention has a glass transition point (Tg) of preferably 40 to 100° C., more preferably 40 to 80° C., or still more preferably 45 to 70° C. When the glass transition point is lower than 40° C., the blocking resistance of the toner reduces. When the glass transition point exceeds 100° C., the low-temperature offset resistance of the toner, and the transparency of a transmission image of a film for an overhead projector are apt to reduce.

The content of the THF insoluble matter of the toner of the present invention is preferably 0.0 mass % or more to less than 16.0 mass %, more preferably 0.0 mass % or more to less than 10.0 mass %, or still more preferably 0.0 mass % or more to less than 5.0 mass % with respect to the binder resin of the toner. When the content of the THF insoluble matter is 16.0 mass % or more, low-temperature fixability is apt to reduce.

The THF insoluble matter of the toner particles shows the mass ratio of an ultrahigh molecular weight polymer component (substantially a crosslinking polymer) that is insoluble in a THF solvent. A value measured as described below is defined as the THF insoluble matter of the toner.

1.0 g of the toner is weighed ($W_1$ (g)). The weighed toner is placed into extraction thimble (such as No. 86R manufactured by ADVANTEC), and the whole is subjected to extraction with a Soxhlet extractor by using 200 ml of THF as a solvent for 20 hours. After a solubilized component obtained by the extraction with the solvent has been evaporated, the resultant is dried in a vacuum at 40° C. for several hours. Then, the amount of a THF-soluble resin component is weighed ($W_2$ (g)). The weight of a component except the resin component in the toner particles such as a pigment is denoted by ($W_3$ (g)). The content of the THF insoluble matter can be determined from the following equation.

$$THF \text{ insoluble matter mass } (\%) = \left[\frac{W_1 - (W_3 + W_2)}{(W_1 - W_3)}\right] \times 100$$

The THF insoluble matter of the toner can be adjusted depending on the degree of polymerization and degree of crosslinking of the binder resin.

A weight average molecular weight (Mw) in the gel permeation chromatography (GPC) of tetrahydrofuran (THF) soluble matter in the toner of the present invention is 15,000 to 80,000. Such toner favorably exerts environmental stability and duration stability.

The weight average molecular weight in the gel permeation chromatography (GPC) of the tetrahydrofuran (THF) soluble matter in the toner is more preferably 20,000 to 50,000. When the weight average molecular weight in the gel permeation chromatography (GPC) of the tetrahydrofuran (THF) soluble matter in the toner is less than 15,000, blocking resistance and durability are apt to deteriorate. When the weight average molecular weight exceeds 80,000, low-temperature fixability and a high-gloss image are hardly obtained.

In addition, the ratio (Mw/Mn) of the weight average molecular weight to number average molecular weight in the gel permeation chromatography (GPC) of the tetrahydrofuran (THF) soluble matter in the toner of the present invention is preferably 5 to 100. When the ratio (Mw/Mn) is less than 5, a fixable temperature region may be narrow. When the ratio is 100 or more, low-temperature fixability may deteriorate.

In the present invention, organic compounds such as: sodium salts of polyvinyl alcohol, gelatin, methylcellulose, methylhydroxypropylcellulose, ethylcellulose, and carboxymethylcellulose; polyacrylic acid and a salt of the acid; polymethacrylic acid and a salt of the acid; and starch may be used as a dispersion stabilizer to be used in producing the toner by employing a polymerization method. Each of those dispersion stabilizers is preferably used in an amount of 0.2 to 20 parts by mass with respect to 100 parts by mass of the polymerizable monomer.

When an inorganic compound from among the dispersion stabilizers is used, a commercially available inorganic compound may be directly used. Alternatively, the inorganic compound may be produced in an aqueous dispersion medium in order to obtain fine particles. For example, calcium phosphate can be produced by mixing an aqueous solution of sodium phosphate and an aqueous solution of calcium chloride under high-speed stirring.

A surfactant may be used in an amount of 0.001 to 0.1 part by mass with respect to 100 parts by mass of the polymerizable monomer for finely dispersing the dispersion stabilizer. The use is intended for the promotion of an initial action of the above-mentioned dispersion stabilizer. Specific examples of the surfactant include sodium dodecylbenzenesulfonate, sodium tetradecyl sulfate, sodium pentadecyl sulfate, sodium octyl sulfate, sodium oleate, sodium laurate, sodium octylate, sodium stearate, and calcium oleate.

Known colorants can be used as those used in the present invention.

Examples of a black pigment include carbon black, aniline black, non-magnetic ferrite, and magnetite.

Examples of a yellow pigment include condensed azo compounds such as yellow iron oxide, navels yellow, naphtol yellow S, hansa yellow G, hansa yellow 10G, benzidine yellow G, benzidine yellow GR, a quinoline yellow lake, permanent yellow NCG, and a tartrazine lake; an isoindoline compound; an anthraquinone compound; an azo metal complex; a methine compound; and an allyl amide compound. Specifically, C.I. Pigment Yellow 12, 13, 14, 15, 17, 62, 74, 83, 93, 94, 95, 109, 110, 111, 128, 129, 147, 155, 168, 180, or the like can be preferably used.

Examples of an orange pigment include permanent orange GTR, pyrazolone orange, balkan orange, benzidine orange G, indanthrene brilliant orange RK, and indanthrene brilliant orange GK.

Examples of a red pigment include condensed azo compounds such as colcothar, permanent red 4R, lithol red, pyrazolone red, watching red calcium salt, lake red C, lake red D, brilliant carmine 6B, brilliant carmine 3B, an eoxyn lake, rhodamine lake B, and an alizarine lake; a diketopyrrolopyrrol compound; anthraquinone; a quinacridone compound; a base dyed lake compound; a naphtol compound; a benzimidazolon compound; a thioindigo compound; and a perylene compound. Specifically, C.I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254 are particularly preferable.

Examples of a blue pigment include a copper phthalocyanine compounds or derivatives thereof such as an alkali blue lake, a Victoria blue lake, phthalocyanine blue, metal-free phthalocyanine blue, a partial chloride of a phthalocyanine blue, fast sky blue, indanthrene blue BG; an anthraquinone compound; and a basic dye lake compound. Specifically, C.I. PIGMENT Blue 1, 7, 15, 15:1, 15:2, 15:3, 15:4, 60, 62, 66, and the like are particularly preferable.

Examples of a violet pigment include fast violet B and a methyl violet lake.

Examples of a green pigment include Pigment Green B, a malachite green lake, and final yellow green G. Examples of a white pigment include zinc white, titanic oxide, antimony white, and zinc sulfide.

One kind of those colorants can be used alone, or two or more kinds of them can be used as a mixture. Further, each of the colorants can be used in the state of a solid solution.

In the present invention, attention must be paid to the polymerization inhibiting property and the dispersion medium migration characteristic possessed by the colorant for producing toner particles by employing a polymerization method. The surface of the colorant may be modified as required by subjecting the colorant to a surface treatment with a substance having no polymerization inhibiting property. Particular attention should be paid upon use of dyes and carbon black because many of them each have polymerization inhibiting property.

An example of a preferable method of treating dyes is a method involving polymerizing a polymerizable monomer in advance in the presence of these dyes and adding the resultant colored polymer to a polymerizable monomer composition. In addition, carbon black may be subjected to a treatment with a substance that reacts with a surface functional group of carbon black (such as organosiloxane) as well as a treatment similar to those of the above dyes.

The toner of the present invention can be used as each of non-magnetic toner and magnetic toner. When the toner of the present invention is used as magnetic toner, a magnetic powder may be incorporated into the toner. A substance that is magnetized when placed in a magnetic field is used as such magnetic powder, and examples of the substance include: powders of ferromagnetic metals such as iron, cobalt, and nickel; and powders of magnetic iron oxides such as magnetite and ferrite.

When a magnetic toner particle is obtained by employing a polymerization method, attention must be paid to, for example, polymerization inhibiting property and a dispersion medium migration characteristic possessed by a magnetic material, and surface modification (such as a surface treatment with a substance having no polymerization inhibiting property) is preferably performed as required.

In the process for producing the toner particles, the temperature may be increased in the latter half of the polymerization reaction. Further, in order that an unreacted polymerizable monomer or by-product responsible for an odor at the time of the fixation of the toner may be removed, part of the dispersion medium may be removed by distillation from a reaction system in the latter half of the polymerization reaction, or after the completion of the polymerization reaction. After the completion of the reaction, produced toner particles are washed, collected by filtration, and dried.

In a suspension polymerization method, water is preferably used as a dispersion medium in an amount of 300 to 3,000 parts by mass with respect to 100 parts by mass of the polymerizable monomer composition.

A fixable temperature domain in the fixation of the toner of the present invention refers to a temperature domain between the temperature at which low-temperature offset is completed and the temperature at which high-temperature offset is initiated.

Methods of measuring the physical properties of the toner of the present invention and methods of evaluating the toner for physical properties will be described below.

(Measurement of Molecular Weight)

A molecular weight in the present invention is measured with each of a GPC-RI and a GPC-MALLS under the following conditions.

After 0.04 g of a resin for toner has been dispersed and dissolved in 20 ml of THF, the resultant is left standing for 24 hours. After that, the resultant is filtrated through a 0,2-μm filter (for example, a Myshori Disc H-25-2 (manufactured by TOSOH CORPORATION) or an Ekicrodisk 25CR (manufactured by Gelman Science Japan) can be preferably utilized), and the filtrate is used as a sample.

| (Analysis conditions) | |
|---|---|
| Separating column: | Shodex KF-807, KF-805, KF-803, or KF-G (trade name, manufactured by Showa Denko K.K.) |
| Column temperature: | 40° C. |
| Mobile phase solvent: | THF |
| Mobile phase flow rate: | 1.0 ml/min. |
| Sample concentration: | About 0.2% |
| Injection amount: | 400 μl |
| Detector 1: | Multi-angle light scattering detector Wyatt DAWN EOS (using a 90° detector) (trade name, manufactured by SHOKO Co., Ltd.) |
| Detector 2: | Differential refractive index detector Shodex RI-71 (trade name, manufactured by Showa Denko K.K.) |

(Measurement Theory)

$LS=(dn/dc)^2 \times C \times Mabs \times KLS$

LS: Voltage value measured with detector (V)

dn/dc: Increment of refractive index per 1 g of sample (ml/g)

In the present invention, the value was set to the document value of polystyrene, that is, 0.185 ml/g.

C: Concentration of solution (g/ml)

Mabs: Absolute molecular weight

KLS: Coefficient (device constant) between measured voltage and scattering intensity (reduction Rayleigh ratio)

In an MALLS, separation is performed at a molecular size by the molecular sieve of a column, and the absolute molecular weight (Mabs) and the concentration (C) change ceaselessly, so measurement must be performed by using the MALLS in combination with a separately prepared concentration detector. The absolute molecular weight (Mabs) is determined by converting a voltage measured with the detector into the concentration C. In the present invention, a differential refractive index detector (RI) is used as a concentration detector, and the signal strength (RI) of the RI detector is converted into the concentration (C).

$RI=(dn/dc) \times C \times KRI$

KRI: Coefficient between measured voltage and refractive index (RI constant: calibrated with reference to polystyrene)

A molecular size [radius of inertia (Rw)] was calculated by Debye Plot.

In the present invention, a molecular weight measured with a differential refractive index detector (RI) is defined as Mr. An absolute molecular weight calculated from a result of measurement with a GPC-multi-angle laser light scattering detector (MALLS) is defined as Mabs.

In general, in the measurement of a chromatogram by GPC, in higher molecular weights, measurement is initiated from a point at which the chromatogram starts to rise from a baseline, and, in lower molecular weights, measurement is performed up to a molecular weight of about 400.

(Measurement of Endothermic Main Peak and Heat Quantity Integrated Value by Using DSC)

Figure 6:
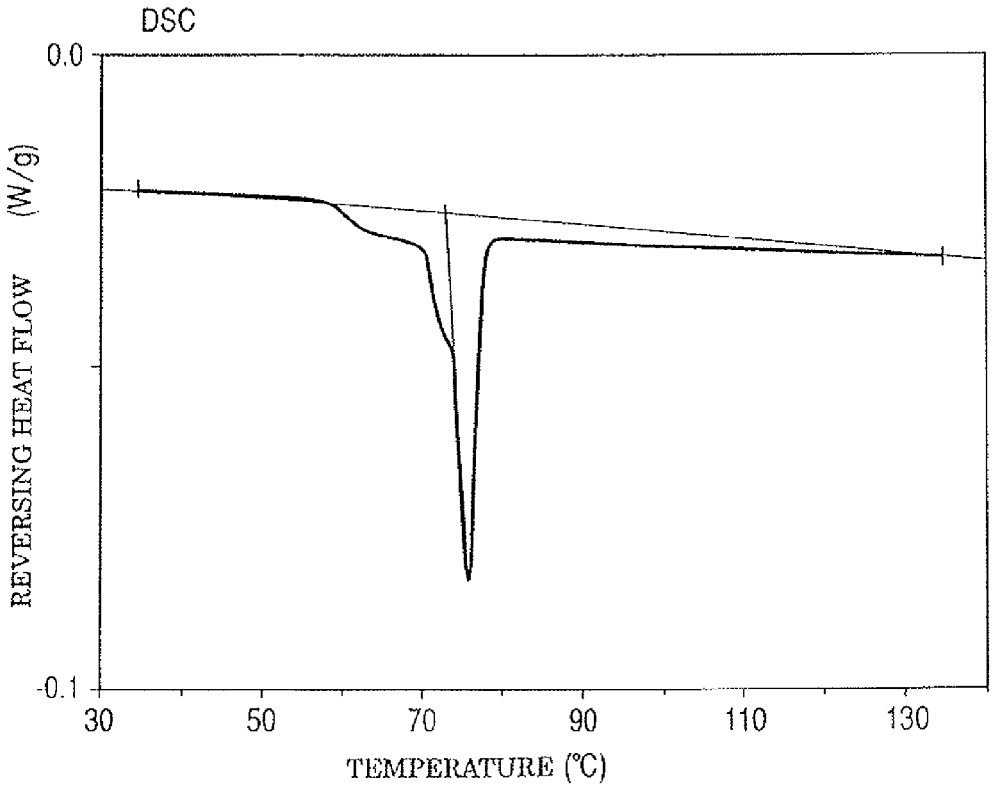
FIG. 6 is a view showing an example of the endothermic chart of the toner measured by DSC.

In the present invention, an M-DSC (trade name, manufactured by TA Instruments) is used as a differential scanning calorimeter (DSC). 6 mg of a toner sample to be measured is weighed. The sample is loaded into an aluminum pan, and measurement is performed by using an empty aluminum pan as a reference in the measurement temperature range of 20 to 200° C. at a rate of temperature increase of 1° C./min and at normal temperature and normal humidity. A modulation amplitude and a frequency at this time are ±0.5° C. and 1/min, respectively. A maximum glass transition point Tg (° C.) is calculated from the resultant reversing heat flow curve. Tg is determined to be the central value of the point of intersection of a baseline before and after the absorption of heat and the tangent of a curve provided by the absorption of heat as Tg (° C.). An endotherm (J), which is represented by the peak area of an endothermic main peak in an endothermic chart at the time of temperature increase measured with the DSC, converted into a heat quantity per 1 g of the toner, that is, a heat quantity integrated value (J/g) is measured. FIG. 6 shows an example of a reversing heat flow curve obtained as a result of the DSC measurement of the toner. The heat quantity integrated value (J/g) is determined by using the reversing heat flow curve obtained as a result of the above measurement. Analytical software Universal Analysis Ver. 2.5H (manufactured by TA Instruments) is used for calculation. The heat quantity integrated value (J/g) is determined from the region surrounded by the straight line connecting the points of measurement at 35° C. and 135° C. and an endothermic curve by using the function of Integral Peak Linear.

(Measurement of Weight Average Particle Diameter (D4) of Toner)

To 100 to 150 ml of an electrolytic solution is added 0.1 to 5 ml of a surfactant (alkylbenzenesulfonate salt), and 2 to 20 mg of a measurement sample is added to the resultant. The electrolyte solution into which the sample has been suspended is subjected to a dispersion treatment by using an ultrasonic dispersing unit for 1 to 3 minutes. The particle size distribution of particles each having a particle diameter of 2 to 40 μm on a volume basis is measured by using a Coulter Multisizer (manufactured by Coulter Scientific Japan, Co.) and a 100-μm aperture, and the weight average particle diameter (D4) of the toner is calculated.

EXAMPLES

Hereinafter, the present invention will be described by way of examples. However, the present invention is not limited by those examples. It should be noted that the term "part(s)" to be used in the examples and comparative examples represents "part(s) by mass".

(Synthesis Examples of Resins)

Production Example of Styrene-Based Resin (1)

35 parts by mass of xylene was loaded into a pressure-resistant reactor equipped with a dropping funnel, a Liebig condenser, and a stirrer, and the temperature of xylene was increased to 200° C. The pressure at this time was 0.3 MPa. A mixture of 100 parts by mass of a styrene monomer, 0.1 part of n-butyl acrylate, and 3.5 parts of di-tert-butyl peroxide was loaded into the dropping funnel, and was dropwise added to xylene at 200° C. over 2 hours under pressure (0.3 MPa). After the dropping, the resultant was subjected to a reaction at 200° C. for an additional 2 hours. Then, solution polymerization was completed, and xylene was removed. The resultant styrene-based resin had a weight average molecular weight of 3,160 and Tg of 55° C. The resin is defined as Styrene-based resin (1).

Production Examples of Styrene-Based Resin (2)

600 parts by mass of xylene was loaded into a reactor equipped with a dropping funnel, a Liebig condenser, a nitrogen sealing pipe (nitrogen flow rate: 100 ml/min), and a stirrer, and the temperature of xylene was increased to 135° C. A mixture of 100 parts by mass of a styrene monomer, 0.1 part of n-butyl acrylate, and 17 parts of di-tert-butyl peroxide was loaded into the dropping funnel, and was dropwise added to xylene at 135° C. over 2 hours under normal pressure. The resultant was subjected to a reaction for an additional 2 hours under the reflux of xylene (137 to 145° C.). Then, solution polymerization was completed, and xylene was removed. The resultant styrene-based resin had a weight average molecular weight of 3,200 and Tg of 56° C. The styrene-based resin is defined as Styrene-based resin (2).

Production Examples of Styrene-Based Resins (3) and (4)

Styrene-based Resins (3) and (4) were each obtained by performing solution polymerization in the same manner as in Production Example of Styrene-based Resin (1) except for the composition ratio of each of a monomer composition and a polymerization initiator, and reaction conditions shown in Table 4.

Production Example of Styrene-Based Resin (5)

A mixture of 20 parts by mass of xylene, 80 parts by mass of styrene, 20 parts by mass of n-butyl acrylate, and 2 parts by mass of di-tert-butyl peroxide as a polymerization initiator was loaded into a reactor equipped with a Liebig condenser and a stirrer, and polymerization was performed at a temperature of 100° C. for 24 hours. After that, the xylene was removed, whereby Styrene-based resin (5) was obtained. The resultant styrene-based resin had a weight average molecular weight of 420,000 and Tg of 62° C. The resin is defined as Styrene-based resin (5).

Production Example of Styrene-Based Resins (6)

Styrene-based Resin (6) was obtained by performing solution polymerization in the same manner as in Production Example of Styrene-based Resin (5) except for the composition ratio of each of a monomer composition and a polymerization initiator, and reaction conditions shown in Table 4.

Table 4 shows the physical properties of Styrene-based Resins (1) to (6) obtained in the foregoing collectively.

Example 1

720 parts by mass of ion-exchanged water and 935 parts by mass of a 0,1-mol/l aqueous solution of $Na_3PO_4$ were added to a four-necked container, and the temperature of the whole was kept at 60° C. while the whole was stirred by using a high-speed stirring device TK-Homomixer at 11,000 rpm. 75 parts by mass of a 1,0-mol/l aqueous solution of $CaCl_2$ were gradually added to the resultant, whereby an aqueous dispersion medium containing a fine, hardly water-soluble dispersion stabilizer $Ca_3(PO_4)_2$ was prepared.

| | |
|---|---|
| Styrene monomer | 64 parts by mass |
| n-butyl acrylate | 16 parts by mass |
| Copper phthalocyanine pigment (Pigment Blue 15:3) | 6.5 parts by mass |
| Styrene-based resin (1) (Mw = 3,200, Mw/Mn = 1.19) | 20 parts by mass |
| Polyester-based resin (1) | 5 parts by mass |
| Negative charge control agent (aluminum compound of 3,5-di-tert-butylsalicylic acid) | 0.4 part by mass |
| Wax (Fischer-Tropsch wax; melting point: 78.2° C.) | 10 parts by mass |

The mixture of the above monomers was dispersed by using an attritor for 3 hours, whereby Monomer Mixture 1 was obtained. 8.0 parts by mass by mass of 1,1,3,3-tetramethylbutylperoxy-2-ethylhexanoate (50% toluene solution) as a polymerization initiator was added to Monomer Mixture 1, whereby a polymerizable monomer composition was obtained. The composition was loaded into an aqueous dispersion medium, and the whole was granulated for 5 minutes while the number of revolutions of a stirrer was kept at 10,000 rpm. After that, a high-speed stirring device was changed to a propeller type agitator, the temperature inside the agitator was increased to 70° C., and the granulated product was subjected to a reaction for 6 hours while being slowly stirred. Tables 1a and 1b show raw materials and polymerization conditions, Table 4 shows the physical properties of a styrene-based resin (addition-reactive resin having a double bond), and Table 5 shows the physical properties of Polyester-based Resin (1).

Next, the temperature in the container was increased to 80° C., and the temperature was kept for 4 hours. After that, the temperature was gradually cooled to 30° C. at a cooling rate of 1° C./min, whereby Slurry 1 was obtained. Dilute hydrochloric acid was added to the container containing Slurry 1, and the dispersion stabilizer was removed. Further, the remainder was separated by filtration, washed, and dried, whereby polymer particles (Toner particles 1) having a weight average particle diameter of 5.8 μm were obtained.

2.0 parts by mass of hydrophobic silica having a specific surface area according to a BET method of 200 $m^2/g$ and 0.1 part by mass of titanium oxide having a specific surface area according to the BET method of 100 $m^2/g$ were externally added to Toner particles 1 (100 parts by mass) obtained, whereby Toner (1-1) were obtained. The physical properties of Toner (1-1) were measured. Table 1a and Table 1b show the results.

Table 6a and Table 6b show the measurements of a molecular weight distribution chart (RI and MALLS) measured by the GPC of THF soluble matter of Toner (1-1).

(Fixation Test)

An unfixed toner image (0.5 $mg/cm^2$) was pressed against receiver paper (75 $g/m^2$) under heat in an oilless manner in the fixing temperature range of 110 to 250° C. at an interval of 5° C. and at a process speed of 150 mm/sec by using a reconstructed fixing unit obtained by reconstructing a fixing unit of a full-color laser beam printer (LBP-2510, manufactured by Canon Inc.) in such a manner that the fixing temperature of the fixing unit could be adjusted, whereby a fixed image was formed on the receiver paper.

(Evaluation for Low-Temperature Fixability and High-Temperature Offset Resistance)

A 1-cm square fixed image was rubbed with three sheets of wipe (trade name Kimwipe S-200, manufactured by NIPPON PAPER CRECIA CO., LTD.) ten times under a load of 75 $g/cm^2$. The temperature at which the percentage by which the density of the fixed image reduced after the rubbing as compared to the density of the fixed image before the rubbing became less than 5% was defined as the fixing temperature of toner. The lowest fixing temperature was used as a criterion for evaluation of low-temperature fixability while the highest fixing temperature was used as a criterion for evaluation of high-temperature offset resistance.

(Measurement of Image Density)

The image density of the fixed image portion of an image which was output under each of a low-temperature, low-humidity (L/L) environment (15° C./15% RH), a normal-temperature, normal-humidity (N/N) environment (25° C./60% RH), and a high-temperature, high-humidity (H/H) environment (32° C./78% RH) was measured with a Macbeth densitometer ($R^D$-914; manufactured by GretagMacbeth) and an SPI auxiliary filter.

(Measurement of Endurance Image Density)

In Case of Non-Magnetic Toner

A reconstructed device of a full-color laser beam printer (LBP-2510, manufactured by Canon Inc.) was used. 200 g of toner was set in a process cartridge under each of a low-temperature, low-humidity environment (15° C./15% RH), a normal-temperature, normal-humidity environment (25° C./60% RH), and a high-temperature, high-humidity environment (32° C./78% RH), and images each having a printing ratio of 2% were printed out on up to 6,000 sheets by using recording paper (75 mg/cm$^2$). The evaluation for the density of a solid image at the initial stage and the density of a solid image at the time of the output of the 12,000 sheets was performed on the basis of the following criteria.

A: 1.45 or more
B: 1.44 to 1.40
C, 1.39 to 1.35
D: 1.34 to 1.30
E: 1.29 to 1.25
F: 1.24 or less In Case of Magnetic Toner A reconstructed device of a full-color laser beam printer (LBP-2160, manufactured by Canon Inc.) (a process speed was reconstructed to be 150 mm/sec) was used. 500 g of toner was set in a process cartridge under each of a low-temperature, low-humidity environment (15° C./15% RH), a normal-temperature, normal-humidity environment (25° C./60% RH), and a high-temperature, high-humidity environment (32° C./78% RH), and images each having a printing ratio of 2% were printed out on up to 12,000 sheets by using recording paper (75 mg/cm$^2$). The evaluation for the density of a solid image at the initial stage and the density of a solid image at the time of the output of the 12,000 sheets was performed.

An unfixed image for evaluation of a solid image density at the initial stage and an unfixed image for evaluation of a solid image density at the time of the output of the 12,000 sheets were provided by using a reconstructed device of an LBP-2160. The unfixed image was fixed by using a reconstructed fixing unit of an LBP-2510 (manufactured by Canon Inc.) obtained by reconstructing a fixing unit of the LBP-2510 in such a manner that the fixing temperature of the unit could be adjusted as in the case of Example 1. The evaluation was performed on the basis of the following criteria.

A: 1.45 or more
B: 1.44 to 1.40
C: 1.39 to 1.35
D: 1.34 to 1.30
E: 1.29 to 1.25
F: 1.24 or less <Evaluation for Development Stripe>

A half tone image (having a toner applied amount of 0.30 mg/cm$^2$) obtained after the printing of 12,000 sheets was evaluated for development stripe on the basis of the following criteria.

A: A vertical stripe in a sheet-discharge direction that appears to be a development stripe is observed on neither a developing roller nor an image at a half tone portion. A level at which no problem in practical use occurs.

B: Although one to five thin stripes in a circumferential direction are present on both ends of a developing roller, a vertical stripe in a sheet-discharge direction that appears to be a development stripe is not observed on an image at a half tone portion. A level at which no problem in practical use occurs.

C: Several thin stripes in a circumferential direction are present on both ends of a developing roller, and several thin development stripes are observed on an image at a half tone portion. A level at which the stripes can be erased by image processing and no problem in practical use occurs.

D: A large number of development stripes are observed on both a developing roller and an image at a half tone portion and cannot be erased by image processing.

(Fog)

A fog density (%) was calculated from a difference between the degree of whiteness of the white portion of a printout image and the degree of whiteness of transfer paper which were measured with a "REFLECTOMETER" (manufactured by Tokyo Denshoku), and evaluation for image fog was performed on the basis of the following criteria.

A: Less than 1.5%
B: 1.5% or more and less than 2.5%
C: 2.5% or more and less than 4.0%
D: 4% or more (Measurement of $^1$H-NMR (Nuclear Magnetic Resonance)Spectrum)

Measurement was performed under the following conditions.

| | |
|---|---|
| Measuring device: | FT NMR device JNM-EX400 (manufactured by JEOL Ltd.) |
| Measurement frequency: | 400 MHz |
| Pulse condition: | 5.0 μs |
| Data point: | 32,768 |
| Frequency range: | 10,500 Hz |
| Number of integrations: | 10,000 times |
| Measurement temperature: | 60° C. |
| Sample: | 50 mg of a measurement sample |

is placed in a sample tube having a diameter of 5 mm, $CDCl_3$ is added as a solvent, and the whole is dissolved in a thermostat at 60° C. so that a sample is prepared.

Determination of abundance ratio of proton of methine group (—CH═CH—) originating from a double bond by $^1$H-NMR measurement: A strength ratio $S_{4.6\sim4.9}/S_{5.0\sim5.2}$ of the signal of each hydrogen atom (corresponding to $^1$H) of a methine group in 4.6 ppm to 4.9 ppm in a $^1$H-NMR spectrum to the signal of each hydrogen atom (corresponding to $^1$H) of the methine group in 5.0 ppm to 5.2 ppm in the spectrum is determined.

A: A peak is present.
B: No peak is present.

Table 4 shows the results of the evaluation of a styrene-based resin.

(Blocking Test)

10 g of toner particles was loaded into a 100-ml glass bottle, and was left at each of 45° C. and 50° C. for 10 days. After that, a loosened state of the toner was visually judged by rotating the glass bottle (a rotation/second).

A: No change.
B: An aggregate is present, but can be readily loosened.
C: An aggregate is hardly loosened.
D: No fluidity.
E: Apparent caking.

(Evaluation for Gloss)

The gloss value of an image in a fixed image region was measured by using a handy glossmeter Gloss Checker (trade name: IG-310, manufactured by HORIBA, Ltd.).

A process cartridge was filled with 200 g of Toner (1-1), and images each having a printing ratio of 2% were printed out on up to 12,000 sheets under each of a low-temperature, low-humidity environment (15° C./15% RH), a normal-temperature, normal-humidity environment (25° C./60% RH), and a high-temperature, high-humidity environment (32° C./78% RH). Then, evaluation for solid image density at an initial stage and solid image density at the time of the output of 12,000 sheets was performed. Table 7 shows the results of the evaluation. Next, evaluation for fixability was performed. Table 7 shows the results of the evaluation as well.

Example 3

Toner Particles 3 were obtained in the same manner as in Example 1 except that Polyester-based resin (1) of Example 1 was changed from 5 parts by mass to 0 part by mass. Tables 1a and 1b show raw materials and polymerization conditions.

0.8 part by mass of hydrophobic silica having a specific surface area according to a BET method of 200 $m^2/g$ and 0.1 part by mass of titanium oxide having a specific surface area according to a BET method of 100 $m^2/g$ were externally added to Toner Particles 3 (100 parts by mass), whereby Toner (3-1) was obtained. Tables 1a and 1b show the physical properties of Toner (3-1).

The molecular weight distribution of Toner (3-1) thus obtained was measured in the same manner as in Example 1. Tables 6a and 6b show the results of the measurement.

Toner (3-1) was set in a process cartridge of the reconstructed device of a laser beam printer (manufactured by Canon Inc.: LBP-2510) in the same manner as in Example 1, and image evaluation was performed in the same manner as in Example 1. Next, evaluation for fixability was performed in the same manner as in Example 1. Table 7 shows the results.

Example 4

Toner Particles 4 were obtained in the same manner as in Example 1 except that 5 parts by mass of Polyester-based resin (1) of Example 1 was changed to 5 parts by mass of Polyester-based resin (2). Tables 1a and 1b show raw materials and polymerization conditions.

2.0 parts by mass of hydrophobic silica having a specific surface area according to a BET method of 200 $m^2/g$ and 0.1 part by mass of titanium oxide having a specific surface area according to a BET method of 100 $m^2/g$ were externally added to Toner Particles 4 thus obtained (100 parts by mass), whereby Toner (4-1) was obtained. Tables 1a and 1b show the physical properties of Toner (4-1).

The molecular weight distribution of Toner (4-1) thus obtained was measured in the same manner as in Example 1. Tables 6a and 6b show the results of the measurement.

Toner (4-1) was set in a process cartridge of the reconstructed device of a laser beam printer (manufactured by Canon Inc.: LBP-2510) in the same manner as in Example 1, and image evaluation was performed in the same manner as in Example 1. Next, evaluation for fixability was performed in the same manner as in Example 1. Table 7 shows the results.

Example 5

Toner Particles 5 were obtained in the same manner as in Example 1 except that 10 parts by mass of Fischer-Tropsch wax of Example 1 was changed to 20 parts by mass of Fischer-Tropsch wax. Tables 1a and 1b show raw materials and polymerization conditions.

0.8 part by mass of hydrophobic silica having a specific surface area according to a BET method of 200 $m^2/g$ and 0.1 part by mass of titanium oxide having a specific surface area according to a BET method of 100 $m^2/g$ were externally added to Toner Particles 5 (100 parts by mass), whereby Toner (5-1) was obtained. Tables 1a and 1b show the physical properties of Toner (5-1).

The molecular weight distribution of Toner (5-1) thus obtained was measured in the same manner as in Example 1. Tables 6a and 6b show the results of the measurement.

Toner (5-1) was set in a process cartridge of the reconstructed device of a laser beam printer (manufactured by Canon Inc.: LBP-2510) in the same manner as in Example 1, and image evaluation was performed in the same manner as in Example 1. Next, evaluation for fixability was performed in the same manner as in Example 1. Table 7 shows the results.

Example 6

A ferrite carrier (500 parts by mass) having a particle diameter of 40 μm and the surface of which had been coated with a styrene-methyl methacrylate copolymer was added to Slurry 1 (100 parts by mass) obtained in Example 1, and the whole was uniformly stirred at 60° C. for 1 hour by using a stirring blade. After the temperature of the resultant had been cooled to 30° C., dilute hydrochloric acid was added to remove a dispersion stabilizer. Further, the remainder was separated by filtration, washed, and dried, whereby Toner particles 6 were obtained. Table 1a and Table 1b show the raw materials and the polymerization conditions.

0.8 parts by mass of hydrophobic silica having a specific surface area according to a BET method of 200 $m^2/g$ and 0.1 part by mass of titanium oxide having a specific surface area according to the BET method of 100 $m^2/g$ were externally added to Toner particles 6 (100 parts by mass), whereby Toner (6-1) was obtained. Table 1a and Table 1b show the physical properties of Toner (6-1).

The molecular weight distribution of Toner (6-1) obtained was measured in the same manner as in Example 1. Table 6a and Table 6b show the measurements.

Toner (6-1) was set in a process cartridge of a reconstructed device of a laser beam printer (manufactured by Canon Inc.: LBP-2510) in the same manner as in Example 1, and was subjected to image evaluation and evaluation for fixability in the same manner as in Example 1. Table 7 shows the results of the image evaluation and the evaluation for fixability.

Toner Particles 7 were obtained in the same manner as in Example 1 except that 0.05 part by mass of divinylbenzene was added to the monomers of Example 1 and Styrene-based resin (1) was changed to Styrene-based resin (2). Tables 1a and 1b show raw materials and polymerization conditions.

Example 9

(Production of Hydrophobic Magnetic Iron Oxide)

An aqueous solution of ferrous sulfate was mixed with a caustic soda solution in an amount of 1.0 to 1.05 equivalents with respect to iron ions, whereby an aqueous solution containing ferrous hydroxide was prepared. The air was blown into the aqueous solution while the pH of the aqueous solution was kept at 8, and an oxidation reaction was performed at 85 to 90° C., whereby a slurry liquid for producing a seed crystal was prepared. Next, to the slurry liquid was added an aqueous solution of ferrous sulfate in an amount of 0.9 to 1.15 equivalents with respect to the initial alkali amount (sodium component of caustic soda). After that, the pH of the slurry liquid was kept at 8, and an oxidation reaction was advanced while the air was blown into the liquid. The pH of the liquid was adjusted to about 6 at the terminal stage of the oxidation reaction before the oxidation reaction was completed. The produced iron oxide particles were washed, filtered, and thereby taken out, and were re-dispersed into another water without being dried. The pH of the re-dispersion liquid was adjusted, and to the liquid was added an n-hexyltrimethoxysilane coupling agent in an amount of 2.5 parts by mass with respect to 100 parts by mass of magnetic iron oxide while the liquid was sufficiently stirred. Then, the resultant was sufficiently stirred. The produced hydrophobic iron oxide particles were washed, filtered, and dried. Next, aggregating particles were shredded, whereby Hydrophobic magnetic iron oxide 1 having a number average particle diameter of 0.17 μm was obtained.

710 parts by mass of ion-exchanged water and 850 parts by mass of a 0,1-mol/l aqueous solution of $Na_3PO_4$ were added to a four-necked container, and the temperature of the whole was kept at 60° C. while the whole was stirred by using a high-speed stirring device TK-Homomixer at 12,000 rpm. 68 parts by mass of a 1,0-mol/l aqueous solution of $CaCl_2$ was gradually added to the resultant, whereby an aqueous dispersion medium containing a fine, hardly water-soluble dispersion stabilizer $Ca_3(PO_4)_2$ was prepared.

| | |
|---|---|
| Styrene monomer | 62 parts by mass |
| n-butyl acrylate | 18 parts by mass |
| Divinylbenzene | 0.05 part by mass |
| Hydrophobic magnetic iron oxide 1 | 95 parts by mass |
| Styrene-based resin (1) | 20 parts by mass |
| Polyester-based resin (1) | 5 parts by mass |
| Negative charge control agent (aluminum compound of 3,5-di-tert-butylsalicylic acid) | 0.4 part by mass |
| Wax (Fischer-Tropsch wax; melting point: 78.2° C.) | 10 parts by mass |

Monomer mixture 2 having the above-mentioned components was dispersed by using an Attritor for 3 hours, and then 8 parts by mass of 1,1,3,3-tetramethylbutylperoxy-2-ethylhexanoate (toluene solution 50%) as a polymerization initiator was added to Monomer mixture 2. After that, the resultant polymerizable monomer composition was loaded into the aqueous dispersion medium, and the whole was granulated for 5 minutes while the number of revolutions of the stirring device was kept at 10,000 rpm. After that, the high-speed stirring device was changed to a propeller type agitator. The temperature in the container was increased to 80° C., and the resultant was subjected to a reaction for 8 hours while being slowly stirred. Table 1a and Table 1b show raw materials and polymerization conditions. Table 4 shows physical properties of styrene-based resins (addition-reactive resins each having a double bond).

Next, the temperature was gradually cooled to 30° C. at a cooling rate of 1° C./min, whereby Slurry 2 was obtained. Dilute hydrochloric acid was added to the container containing Slurry 2, and the dispersion stabilizer was removed. Further, the remainder was separated by filtration, washed, and dried, whereby polymer particles (Toner particles 9) having a weight average particle diameter of 5.7 μm were obtained.

1.0 part by mass of hydrophobic silica having a specific surface area according to a BET method of 120 $m^2/g$ was externally added to Toner particles 9 (100 parts by mass) obtained, whereby Toner (9-1) was obtained. The other physical properties of Toner (9-1) were measured. Table 1a and Table 1b show the results.

Table 6a and Table 6b show the measurements of a molecular weight distribution chart measured by the GPC of THF soluble matter of Toner (9-1).

An 12,000-sheet image output test was performed by using a reconstructed device of an LBP-2160 that is remodeled by removing a fixing device of an LBP-2160 (manufactured by Canon Inc.) and having a process speed of 150 mm/sec as an image forming device at normal temperature and normal humidity. An unfixed image was outputted by using a reconstructed device of an LBP-2160, and was fixed by using a reconstructed fixing unit of an LBP-2510 (manufactured by Canon Inc.) obtained by reconstructing a fixing unit of the LBP-2510 in such a manner that the fixing temperature of the fixing unit could be adjusted as in the case of Example 1.

A process cartridge was filled with 700 g of Toner (9-1), and images each having a printing ratio of 2% were printed out on up to 12,000 sheets under each of a low-temperature, low-humidity environment (L/L) (15° C./15% RH), a normal-temperature, normal-humidity environment (N/N) (25° C./60% RH), and a high-temperature, high-humidity environment (H/H) (32° C./78% RH). Then, evaluation for a solid image density at an initial stage and for a solid image density at the time of the output of the 12,000 sheets was performed. Table 7 shows the results. Next, evaluation for fixability was performed. Table 7 shows the results.

Comparative Example 1

Toner Particles 11 were obtained in the same manner as in Example 1 except that 0.25 part by mass of divinylbenzene was added to the monomers (the styrene monomer and n-butyl acrylate) of Example 1 and Styrene-based resin (1) was changed to Styrene-based resin (2).

2.0 parts by mass of hydrophobic silica having a specific surface area according to a BET method of 200 $m^2/g$ and 0.1 part by mass of titanium oxide having a specific surface area according to a BET method of 100 $m^2/g$ were externally added to Toner Particles 11 thus obtained (100 parts by mass), whereby Toner (11-1) was obtained. Tables 1a and 1b show the physical properties of Toner (11-1).

The molecular weight distribution of Toner (11-1) thus obtained was measured in the same manner as in Example 1. Tables 1a and 1b show the results of the measurement.

Toner (11-1) was set in a process cartridge of the reconstructed device of a laser beam printer (manufactured by Canon Inc.: LBP-2510) in the same manner as in Example 1, and image evaluation was performed in the same manner as in Example 1. Next, evaluation for fixability was performed in the same manner as in Example 1. Table 7 shows the results.

Comparative Example 3

Toner Particles 13 were obtained in the same manner as in Example 1 except that 0.25 part by mass of divinylbenzene was added to the monomers (the styrene monomer and n-butyl acrylate) of Example 1, and the amount of Styrene-based resin (1) was changed from 20 parts by mass to 0 part by mass, and further the amount of 1,1,3,3-tetramethylbutylperoxy-2-ethylhexanoate (50% toluene solution) was changed from 8.0 parts by mass 5.0 parts by mass.

0.8 part by mass of hydrophobic silica having a specific surface area according to a BET method of 200 $m^2/g$ and 0.1 part by mass of titanium oxide having a specific surface area according to a BET method of 100 $m^2/g$ were externally added to Toner Particles 13 (100 parts by mass), whereby Toner (13-1) was obtained. Tables 1a and 1b show the physical properties of Toner (13-1).

The molecular weight distribution of Toner (13-1) thus obtained was measured in the same manner as in Example 1. Tables 6a and 6b show the results of the measurement.

Toner (13-1) was set in a process cartridge of the reconstructed device of a laser beam printer (manufactured by Canon Inc.: LBP-2510) in the same manner as in Example 1, and image evaluation was performed in the same manner as in Example 1. Next, evaluation for fixability was performed in the same manner as in Example 1. Table 7 shows the results.

Comparative Example 4

Toner Particles 14 were obtained in the same manner as in Example 1 except that 1.00 part by mass of divinylbenzene was added to the monomers (the styrene monomer and n-butyl acrylate) of Example 1 and Styrene-based resin (1) and 8.0 parts by mass of 1,1,3,3-tetramethylbutylperoxy-2-ethylhexanoate (50% toluene solution) were changed to Styrene-based resin (2) and 10 parts by mass of the same ethylhexanoate, respectively.

0.8 part by mass of hydrophobic silica having a specific surface area according to a BET method of 200 $m^2/g$ and 0.1 part by mass of titanium oxide having a specific surface area according to a BET method of 100 $m^2/g$ were externally added to Toner Particles 14 (100 parts by mass), whereby Toner (14-1) was obtained. Tables 1a and 1b show the physical properties of Toner (14-1).

The molecular weight distribution of Toner (14-1)thus obtained was measured in the same manner as in Example 1. Tables 6a and 6b show the results of the measurement.

Toner (14-1) was set in a process cartridge of the reconstructed device of a laser beam printer (manufactured by Canon Inc.: LBP-2510) in the same manner as in Example 1, and image evaluation was performed in the same manner as in Example 1. Next, evaluation for fixability was performed in the same manner as in Example 1. Table 7 shows the results.

Comparative Example 5

| | |
|---|---|
| Styrene-based Resin (2) | 60 parts by mass |
| Styrene-based Resin (5) | 40 parts by mass |
| Polyester-based Resin (1) | 5 parts by mass |
| Copper phthalocyanine (Pigment Blue 15:3) | 6.5 parts by mass |
| Negative charge control agent (aluminum compound of 3,5-di-tert-butylsalicylate) | 0.4 part by mass |
| Wax [Fischer-Tropsch wax, melting point: 78° C.] | 10 parts by mass |

The above materials were mixed with a Henschel mixer. After that, the resultant was melted and kneaded with a biaxial kneading extruder at 130° C. The kneaded product was cooled, coarsely pulverized with a cutter mill, and pulverized by using a pulverizer using a jet stream. Further, the pulverized product was classified by using an air classifier, whereby Toner Particles 15 having a weight average particle diameter of 6.7 μm were obtained.

2.0 parts by mass of hydrophobic silica having a specific surface area according to a BET method of 200 $m^2/g$ and 0.1 part by mass of titanium oxide having a specific surface area according to a BET method of 100 $m^2/g$ were externally added to Toner Particles 15 thus obtained (100 parts by mass), whereby Toner (15-1) was obtained. Tables 1a and 1b show the physical properties of Toner (15-1).

The molecular weight distribution of Toner (15-1)thus obtained was measured in the same manner as in Example 1. Tables 6a and 6b show the results of the measurement.

Toner (15-1) was set in a process cartridge of the reconstructed device of a laser beam printer (manufactured by Canon Inc.: LBP-2510) in the same manner as in Example 1, and image evaluation was performed in the same manner as in Example 1. Next, evaluation for fixability was performed in the same manner as in Example 1. Table 7 shows the results.

Comparative Example 7

Toner Particles 17 were obtained in the same manner as in Example 1 except that 0.20 part by mass of divinylbenzene was added to the monomers (the styrene monomer and n-butyl acrylate) of Example 1 and 20 parts by mass of Styrene-based resin (1) and 8.0 parts by mass of 1,1,3,3-tetramethylbutylperoxy-2-ethylhexanoate (50% toluene solution) were changed to 0 part by mass of the same resin and 7.0 parts by mass of the same ethylhexanoate, respectively.

2.0 parts by mass of hydrophobic silica having a specific surface area according to a BET method of 200 $m^2/g$ and 0.1 part by mass of titanium oxide having a specific surface area according to a BET method of 100 $m^2/g$ were externally added to Toner Particles 17 (100 parts by mass), whereby Toner (17-1) was obtained. Tables 1a and 1b show the physical properties of Toner (17-1).

The molecular weight distribution of Toner (17-1) thus obtained was measured in the same manner as in Example 1. Tables 6a and 6b show the results of the measurement.

Toner (17-1) was set in a process cartridge of the reconstructed device of a laser beam printer (manufactured by Canon Inc.: LBP-2510) in the same manner as in Example 1, and image evaluation was performed in the same manner as in Example 1. Next, evaluation for fixability was performed in the same manner as in Example 1. Table 7 shows the results.

TABLE 1a

| | | | Example 1 | Example 3 | Example 4 | Example 5 |
|---|---|---|---|---|---|---|
| Toner particles | | | Toner Particles 1 | Toner base Particles 3 | Toner Particles 4 | Toner Particles 5 |
| Monomer | Styrene | Parts by mass | 64.0 | 64.0 | 64.0 | 64.0 |
| | n-butyl acrylate | Parts by mass | 16.0 | 16.0 | 16.0 | 16.0 |
| | Divinylbenzene | Parts by mass | — | — | — | — |
| Resin | Styrene-based resin | Kind | (1) | (1) | (1) | (1) |
| | | Parts by mass | 20 | 20 | 20 | 20 |
| | | Weight average molecular weight (Mw) | 3,160 | 3,160 | 3,160 | 3,160 |
| | | Glass transition point (° C.) | 55 | 55 | 55 | 55 |
| | | Kind | St/BA | St/BA | St/BA | St/BA |
| | Polyester-based resin | Kind | (1) | — | (2) | (1) |
| | | Parts by mass | 5 | — | 5 | 5 |
| | | Weight average molecular weight (Mw) | 10,500 | — | 11,000 | 10,500 |
| Wax | | Kind | Fischer-Tropsch | Fischer-Tropsch | Fischer-Tropsch | Fischer-Tropsch |
| | | Parts by mass | 10 | 10 | 10 | 20 |
| | | Melting point (° C.) | 78.2 | 78.2 | 78.2 | 78.2 |
| | | Endotherm (J/g) | 209.2 | 209.2 | 209.2 | 209.2 |

TABLE 1a-continued

| | | | | | | |
|---|---|---|---|---|---|---|
| Colorant | Copper phthalocyanine | Parts by mass | 6.5 | 6.5 | 6.5 | 6.5 |
| | Iron oxide | Parts by mass | — | — | — | — |
| Negative charge control agent | | Parts by mass | 0.4 | 0.4 | 0.4 | 0.4 |
| Polymerization initiator | 1,1,3,3-tetramethylbutylperoxy-2-ethylhexanoate | Parts by mass | 8.0 | 8.0 | 8.0 | 8.0 |
| Polymerization condition | | Temperature | 70 | 70 | 70 | 70 |
| | | Retention time (hours) | 6 | 6 | 6 | 6 |
| | | Temperature | 80 | 80 | 80 | 80 |
| | | Retention time (hours) | 4 | 4 | 4 | 4 |
| Toner | | | Toner (1-1) | Toner (3-1) | Toner (4-1) | Toner (5-1) |
| Toner physical properties | THF insoluble matter (%) | | 0.8 | 0.7 | 0.8 | 0.8 |
| | Average circularity | | 0.986 | 0.981 | 0.989 | 0.984 |
| | Mode circularity | | 1.00 | 1.00 | 1.00 | 1.00 |
| | Weight average molecular weight (Mw) | | 34,000 | 33,000 | 34,000 | 46,000 |
| | Weight average particle diameter (μm) | | 5.8 | 5.8 | 5.8 | 5.8 |
| | Endothermic main peak temperature (° C.) | | 70.3 | 70.4 | 70.4 | 70.3 |
| | Heat quantity integrated value (J/g) | | 19.1 | 19.8 | 19.4 | 36.4 |
| | Glass transition point (° C.) | | 61.2 | 59.8 | 61.4 | 60.2 |

| | | | Example 6 | Example 9 |
|---|---|---|---|---|
| Toner particles | | | Toner Particles 6 | Toner Particles 9 |
| Monomer | Styrene | Parts by mass | 64.0 | 62.0 |
| | n-butyl acrylate | Parts by mass | 16.0 | 18.0 |
| | Divinylbenzene | Parts by mass | — | 0.05 |
| Resin | Styrene-based resin | Kind | (1) | (1) |
| | | Parts by mass | 20 | 20 |
| | | Weight average molecular weight (Mw) | 3,160 | 3,160 |
| | | Glass transition point (° C.) | 55 | 55 |
| | | Kind | St/BA | St/BA |
| | Polyester-based resin | Kind | (1) | (1) |
| | | Parts by mass | 5 | 5 |
| | | Weight average molecular weight (Mw) | 10,500 | 10,500 |
| Wax | | Kind | Fischer-Tropsch | Fischer-Tropsch |
| | | Parts by mass | 10 | 10 |
| | | Melting point (° C.) | 78.2 | 78.2 |
| | | Endotherm (J/g) | 209.2 | 209.2 |
| Colorant | Copper phthalocyanine | Parts by mass | 6.5 | — |
| | Iron oxide | Parts by mass | — | 95 |
| Negative charge control agent | | Parts by mass | 0.4 | 0.4 |
| Polymerization initiator | 1,1,3,3-tetramethylbutylperoxy-2-ethylhexanoate | Parts by mass | 8.0 | 8.0 |
| Polymerization condition | | Temperature | 70 | 80 |
| | | Retention time (hours) | 6 | 8 |
| | | Temperature | 80 | — |
| | | Retention time (hours) | 4 | — |
| Toner | | | Toner (6-1) | Toner (9-1) |
| Toner physical properties | THF insoluble matter (%) | | 1.5 | 15.4 |
| | Average circularity | | 0.961 | 0.980 |
| | Mode circularity | | 0.98 | 1.00 |
| | Weight average molecular weight (Mw) | | 35,000 | 33,000 |
| | Weight average particle diameter (μm) | | 6.1 | 5.7 |
| | Endothermic main peak temperature (° C.) | | 70.4 | 69.8 |
| | Heat quantity integrated value (J/g) | | 19.7 | 12.4 |
| | Glass transition point (° C.) | | 59.9 | 58.4 |

TABLE 1b

| | | | Comparative Example 1 | Comparative Example 3 | Comparative Example 4 |
|---|---|---|---|---|---|
| Toner particles | | | Toner Particles 11 | Toner Particles 13 | Toner Particles 14 |
| Monomer | Styrene | Parts by mass | 64.0 | 64.0 | 64.0 |
| | n-butyl acrylate | Parts by mass | 16.0 | 16.0 | 16.0 |
| | Divinylbenzene | Parts by mass | 0.25 | 0.25 | 1.00 |

TABLE 1b-continued

| | | | | | |
|---|---|---|---|---|---|
| Resin | Styrene-based resin | Kind | (2) | (2) | (2) |
| | | Parts by mass | 20 | 20 | 20 |
| | | Weight average molecular weight (Mw) | 3,200 | 3,200 | 3,200 |
| | | Glass transition point (° C.) | 56 | 56 | 56 |
| | | Kind | St/BA | St/BA | St/BA |
| | Polyester-based resin | Kind | (1) | (1) | (1) |
| | | Parts by mass | 5 | 5 | 5 |
| | | Weight average molecular weight (Mw) | 10,500 | 10,500 | 10,500 |
| Wax | | Kind | Fischer-Tropsch | Fischer-Tropsch | Fischer-Tropsch |
| | | Parts by mass | 10 | 10 | 10 |
| | | Melting point (° C.) | 78.2 | 78.2 | 78.2 |
| | | Endotherm (J/g) | 209.2 | 209.2 | 209.2 |
| Colorant | Copper phthalocyanine | Parts by mass | 6.5 | 6.5 | 6.5 |
| | Iron oxide | Parts by mass | — | — | — |
| Negative charge control agent | | Parts by mass | 0.4 | 0.4 | 0.4 |
| Polymerization initiator | 1,1,3,3-tetramethylbutylperoxy-2-ethylhexanoate | Parts by mass | 8.0 | 5.0 | 10.0 |
| Polymerization condition | | Temperature | 70 | 70 | 70 |
| | | Retention time (hour) | 6 | 6 | 6 |
| | | Temperature | 80 | 80 | 80 |
| | | Retention time (hour) | 4 | 4 | 4 |
| Toner | | | Toner (11-1) | Toner (13-1) | Toner (14-1) |
| Toner physical properties | THF insoluble matter (%) | | 22.1 | 20.1 | 34.4 |
| | Average circularity | | 0.981 | 0.983 | 0.982 |
| | Mode circularity | | 1.00 | 1.00 | 1.00 |
| | Weight average molecular weight (Mw) | | 48,000 | 68,500 | 57,000 |
| | Weight average particle diameter (μm) | | 5.7 | 5.8 | 5.8 |
| | Endothermic main peak temperature (° C.) | | 70.4 | 70.4 | 70.4 |
| | Heat quantity integrated value (J/g) | | 19.7 | 21.5 | 19.6 |
| | Glass transition point (° C.) | | 60.8 | 61.2 | 61.5 |

| | | | Comparative Example 5 | Comparative Example 7 |
|---|---|---|---|---|
| Toner particles | | | Toner Particles 15 | Toner Particles 17 |
| Monomer | Styrene | Parts by mass | — | 83 |
| | n-butyl acrylate | Parts by mass | — | 17 |
| | Divinylbenzene | Parts by mass | — | 0.20 |
| Resin | Styrene-based resin | Kind | (2) (5) | — |
| | | Parts by mass | 60 40 | — |
| | | Weight average molecular weight (Mw) | 3,200 420,000 | — |
| | | Glass transition point (° C.) | 56 62 | — |
| | | Kind | St/BA St/BA | — |
| | Polyester-based resin | Kind | (1) | (1) |
| | | Parts by mass | 5 | 5 |
| | | Weight average molecular weight (Mw) | 10,500 | 10,500 |
| Wax | | Kind | Fischer-Tropsch | Fischer-Tropsch |
| | | Parts by mass | 10 | 10 |
| | | Melting point (° C.) | 78.2 | 78.2 |
| | | Endotherm (J/g) | 209.2 | 209.2 |
| Colorant | Copper phthalocyanine | Parts by mass | 6.5 | 6.5 |
| | Iron oxide | Parts by mass | — | — |
| Negative charge control agent | | Parts by mass | 0.4 | 0.4 |
| Polymerization initiator | 1,1,3,3-tetramethylbutylperoxy-2-ethylhexanoate | Parts by mass | — | 7.0 |
| Polymerization conditions | | Temperature | — | 70 |
| | | Retention time (hour) | — | 6 |
| | | Temperature | — | 80 |
| | | Retention time (hour) | — | 4 |
| Toner | | | Toner (15-1) | Toner (17-1) |
| Toner physical properties | THF insoluble matter (%) | | 5.8 | 18.2 |
| | Average circularity | | 0.952 | 0.981 |
| | Mode circularity | | 0.96 | 1.00 |
| | Weight average molecular weight (Mw) | | 70,000 | 48,000 |
| | Weight average particle diameter (μm) | | 6.7 | 5.8 |
| | Endothermic main peak temperature (° C.) | | 70.3 | 70.3 |
| | Heat quantity integrated value(J/g) | | 19.7 | 19.7 |
| | Glass transition point(° C.) | | 60.5 | 61.2 |

TABLE 4

| | | | Styrene-based resin No. | | | | | |
|---|---|---|---|---|---|---|---|---|
| | | | (1) | (2) | (3) | (4) | (5) | (6) |
| Composition ratio | Styrene | Part by mass | 100 | 100 | 100 | 100 | 80 | 80 |
| | n-butyl acrylate | Part by mass | 0.1 | 0.1 | 0.1 | — | 20 | 20 |
| | Di-tert-butyl peroxide | Part by mass | 3.5 | 17 | 3.5 | 3 | 2 | 1 |
| | Divinylbenzene | Part by mass | — | — | — | — | — | 0.1 |
| | Xylene | Part by mass | 35 | 600 | 35 | 30 | 20 | 10 |
| Reaction conditions | Reaction temperature | ° C. | 200 | 135 | 215 | 205 | 100 | 90 |
| | Pressure | Mpa | 0.3 | 0.1 | 0.31 | 0.31 | 0.1 | 0.1 |
| Weight average molecular weight (Mw) | | | 3,160 | 3,200 | 3,250 | 7,600 | 420,000 | 830,000 |
| Weight average molecular weight (Mw)/number average molecular weight (Mn) | | | 1.17 | 1.24 | 1.15 | 2.21 | 3.20 | 7.45 |
| Glass transition point (° C.) | | | 55 | 56 | 55 | 60 | 62 | 64 |
| 1H-NMR | 4.6 to 4.9 ppm | | A | B | A | A | B | B |
| | 5.0 to 5.2 ppm | | A | B | A | A | B | B |
| | $S_{4.6\ to\ 4.9}/S_{5.0\ to\ 5.2}$ | | 1.03 | | 1.1 | 1.03 | — | — |

TABLE 5

| | | | | Polyester-based resin No. | |
|---|---|---|---|---|---|
| | | | | (1) | (2) |
| Composition ratio | Polyester-based monomer | Bisphenol A (propylene oxide-denatured) 2-mol adduct | Mole | 10.0 | 9.8 |
| | | Bisphenol A (ethylene oxide-denatured) 2-mol adduct | Mole | 0 | 0 |
| | | Terephthalic acid | Mole | 11.0 | 10.1 |
| | | Maleic acid | Mole | 0 | 0 |
| | Styrene-based monomer | Styrene | Mole | 0 | 15.3 |
| | | Acrylic acid | Mole | 0 | 1.6 |
| | | Di-tert-butylperoxide | Mole | 0 | 2.0 |
| Weight average molecular weight (Mw) | | | | 10,500 | 11,000 |
| Weight average molecular weight (Mw)/Number average molecular weight (Mn) | | | | 3.20 | 3.24 |
| Glass transition point (° C.) | | | | 70 | 68 |

TABLE 6a

| | | | Example 1 Toner Particles 1 | Example 3 Toner Particles 3 | Example 4 Toner Particles 4 | Example 5 Toner Particles 5 |
|---|---|---|---|---|---|---|
| Molecular weight | Molecular weight of main peak | Mr1 | 30,200 | 30,100 | 29,800 | 31,100 |
| | 800,000 to 4,000,000 (Molecular weight of maximum height) | Mr2 | 800,000 | 800,000 | 800,000 | 800,000 |
| | 4,000,000 or more (Molecular weight of maximum height) | Mr3 | — | — | — | — |
| | Molecular weight of main peak | Mm1 | 99,800 | 96,200 | 98,400 | 104,000 |
| | 300,000 to 7,000,000 (Molecular weight of peak) | Mm2 | 3,607,000 | 3,201,000 | 352,000 | 370,000 |
| | 7,000,000 to 20,000,000 (Molecular weight of maximum height) | Mm3 | — | — | — | — |
| | 20,000,000 or more (Molecular weight of maximum height) | Mm4 | — | — | — | — |
| Height | Height of main peak | Hr1 | 1.000 | 1.000 | 1.000 | 1.000 |
| | 80,000 to 800,000 (Maximum height) | | — | — | — | — |
| | 800,000 to 4,000,000 (Maximum height) | Hr2 | 0.003 | 0.002 | 0.004 | 0.003 |
| | 4,000,000 or more (Maximum height) | Hr3 | — | — | — | — |
| | Height of main peak | Hm1 | 1.000 | 1.000 | 1.000 | 1.000 |
| | 300,000 to 7,000,000 (Maximum height) | Hm2 | 0.083 | 0.081 | 0.079 | 0.300 |
| | 7,000,000 to 20,000,000 (Maximum height) | Hm3 | — | — | — | — |

TABLE 6a-continued

| | | | | | | |
|---|---|---|---|---|---|---|
| | 20,000,000 or more (Maximum height) | Hm4 | — | — | — | — |
| | Hm2/Hm1 | | 0.083 | 0.081 | 0.079 | 0.300 |
| | Hm3/Hm1 | | 0.000 | 0.000 | 0.000 | 0.000 |
| Area | S1 | | 0.046 | 0.046 | 0.042 | 0.041 |
| | S2 | | 0.278 | 0.270 | 0.271 | 0.269 |
| | S3 | | 0.676 | 0.684 | 0.687 | 0.690 |
| | S1/S2 | | 0.165 | 0.170 | 0.155 | 0.152 |
| | S3/S2 | | 2.432 | 2.533 | 2.535 | 2.565 |

| | | | Example 6 Toner Particles 6 | Example 9 Toner Particles 9 |
|---|---|---|---|---|
| Molecular weight | Molecular weight of main peak | Mr1 | 30,200 | 27,600 |
| | 800,000 to 4,000,000 (Molecular weight of maximum height) | Mr2 | 800,000 | 800,000 |
| | 4,000,000 or more (Molecular weight of maximum height) | Mr3 | — | — |
| | Molecular weight of main peak | Mm1 | 99,800 | 115,000 |
| | 300,000 to 7,000,000 (Molecular weight of peak) | Mm2 | 3,607,000 | 2,940,000 |
| | 7,000,000 to 20,000,000 (Molecular weight of maximum height) | Mm3 | — | — |
| | 20,000,000 or more (Molecular weight of maximum height) | Mm4 | — | — |
| Height | Height of main peak | Hr1 | 1.000 | 1.000 |
| | 80,000 to 800,000 (Maximum height) | | — | — |
| | 800,000 to 4,000,000 (Maximum height) | Hr2 | 0.003 | 0.130 |
| | 4,000,000 or more (Maximum height) | Hr3 | — | — |
| | Height of main peak | Hm1 | 1.000 | 1.000 |
| | 300,000 to 7,000,000 (Maximum height) | Hm2 | 0.083 | 0.350 |
| | 7,000,000 to 20,000,000 (Maximum height) | Hm3 | — | — |
| | 20,000,000 or more (Maximum height) | Hm4 | — | — |
| | Hm2/Hm1 | | 0.083 | 0.350 |
| | Hm3/Hm1 | | 0.000 | 0.000 |
| Area | S1 | | 0.046 | 0.043 |
| | S2 | | 0.275 | 0.260 |
| | S3 | | 0.679 | 0.697 |
| | S1/S2 | | 0.167 | 0.165 |
| | S3/S2 | | 2.469 | 2.681 |

TABLE 6B

| | | | Comparative example 1 Toner Particles 11 | Comparative example 3 Toner Particles 13 | Comparative example 4 Toner Particles 14 | Comparative example 5 Toner Particles 15 | Comparative example 7 Toner Particles 17 |
|---|---|---|---|---|---|---|---|
| Molecular weight | Molecular weight of main peak | Mr1 | 41,000 | 62,000 | 38,000 | 4,100 | 42,000 |
| | 800,000 to 4,000,000 (Molecular weight of maximum height) | Mr2 | 800,000 | 800,000 | 800,000 | 460,000 | 800,000 |
| | 4,000,000 or more (Molecular weight of maximum height) | Mr3 | — | — | — | — | — |
| | Molecular weight of main peak | Mm1 | 78,000 | 102,000 | 75,000 | 11,000 | 150,000 |
| | 300,000 to 7,000,000 (Molecular weight of peak) | Mm2 | 3,240,000 | 4,360,000 | 6,200,000 | 1,600,000 | 300,000 |
| | 7,000,000 to 20,000,000 (Maximum height) | Mm3 | — | — | — | — | — |
| | 20,000,000 or more (Maximum height) | Mm4 | — | — | — | — | — |
| Height | Height of main peak | Hr1 | 1.000 | 1.000 | 1.000 | 1.000 | 1.000 |
| | 80,000 to 800,000 (Maximum height) | | — | — | — | — | — |
| | 800,000 to 4,000,000 (Maximum height) | Hr2 | 0.250 | 0.250 | 0.280 | 0.410 | 0.021 |
| | 4,000,000 or more (Maximum height) | Hr3 | — | — | — | — | — |
| | Height of main peak | Hm1 | 1.000 | 1.000 | 1.000 | 1.000 | 1.000 |
| | 300,000 to 7,000,000 (Maximum height) | Hm2 | 0.152 | 0.158 | 0.164 | 0.960 | 0.103 |

TABLE 6B-continued

| | | | Comparative example 1 Toner Particles 11 | Comparative example 3 Toner Particles 13 | Comparative example 4 Toner Particles 14 | Comparative example 5 Toner Particles 15 | Comparative example 7 Toner Particles 17 |
|---|---|---|---|---|---|---|---|
| | 7,000,000 to 20,000,000 (Maximum height) | Hm3 | — | — | — | — | — |
| | 20,000,000 or more (Maximum height) | Hm4 | — | — | — | — | — |
| | Hm2/Hm1 | | 0.152 | 0.158 | 0.164 | 0.960 | 0.103 |
| | Hm3/Hm1 | | 0.000 | 0.000 | 0.000 | 0.000 | 0.000 |
| Area | S1 | | 0.046 | 0.043 | 0.048 | 0.046 | 0.055 |
| | S2 | | 0.232 | 0.210 | 0.221 | 0.520 | 0.310 |
| | S3 | | 0.722 | 0.747 | 0.731 | 0.434 | 0.635 |
| | S1/S2 | | 0.198 | 0.205 | 0.217 | 0.088 | 0.177 |
| | S3/S2 | | 3.112 | 1.557 | 3.308 | 0.835 | 2.048 |

TABLE 7

| | | L/L | | | | N/N | | | |
|---|---|---|---|---|---|---|---|---|---|
| | | Initial stage Density | 12,000 sheets Density | 12,000 sheets Fog | 12,000 sheets Development stripe | Initial stage Density | 12,000 sheets Density | 12,000 sheets Fog | 12,000 sheets Development stripe |
| Example 1 | Toner (1-1) | A | A | A | A | A | A | A | A |
| Example 3 | Toner (3-1) | A | A | B | B | A | A | B | B |
| Example 4 | Toner (4-1) | A | A | A | A | A | A | A | A |
| Example 5 | Toner (5-1) | A | A | A | A | A | A | A | B |
| Example 6 | Toner (6-1) | B | B | B | B | A | B | B | B |
| Example 9 | Toner (9-1) | A | A | A | A | A | A | A | A |
| Comparative Example 1 | Toner (11-1) | B | B | A | A | B | B | A | A |
| Comparative Example 3 | Toner (13-1) | A | B | A | A | A | A | A | A |
| Comparative Example 4 | Toner (14-1) | A | B | A | A | A | A | A | A |
| Comparative Example 5 | Toner (15-1) | C | C | C | C | B | C | C | C |
| Comparative Example 7 | Toner (17-1) | A | B | A | A | A | A | A | A |

| | | H/H | | | | Blocking resistance | | Fixability |
|---|---|---|---|---|---|---|---|---|
| | | Initial stage Density | 12,000 sheets Density | 12,000 sheets Fog | 12,000 sheets Development stripe | 45° C. | 50° C. | Fixable temperature domain (° C.) |
| Example 1 | Toner (1-1) | A | A | A | A | A | A | 115-235 |
| Example 3 | Toner (3-1) | A | A | B | B | A | A | 115-230 |
| Example 4 | Toner (4-1) | A | A | A | A | A | A | 115-230 |
| Example 5 | Toner (5-1) | A | A | A | B | A | A | 115-230 |
| Example 6 | Toner (6-1) | B | B | B | B | A | A | 115-230 |
| Example 9 | Toner (9-1) | A | A | A | A | A | A | 120-225 |
| Comparative Example 1 | Toner (11-1) | B | B | A | A | A | A | 140-230 |
| Comparative Example 3 | Toner (13-1) | A | A | A | A | A | A | 140-235 |
| Comparative Example 4 | Toner (14-1) | A | A | A | A | A | A | 145-245 |
| Comparative Example 5 | Toner (15-1) | C | D | C | D | B | C | 120-225 |
| Comparative Example 7 | Toner (17-1) | A | A | A | A | A | A | 135-235 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-058186, filed on Mar. 3, 2006, which is hereby incorporated by reference herein in its entirety.

What is claimed is:

1. A toner comprising toner particles each containing at least a binder resin, a colorant and a wax, wherein:

the binder resin comprises a vinyl-based resin as a main component;

the toner contains tetrahydrofuran (THF) insoluble matter in a content of 0.0 mass % or more to less than 1.5 mass % with respect to the binder resin;

the toner has a main peak (Hr1) in a molecular weight domain Dr1 ranging from 5,000 to 80,000 in measurement of THF soluble matter of the toner with a gel permeation chromatogram (GPC)-differential refractive index detector (RI); and the toner has a main peak in a molecular weight domain Dm1 ranging from 10,000 to 120,000 and at least one peak in a molecular weight domain Dm2 ranging from 300,000 to 7,000,000 in a gel permeation chromatogram (GPC)-differential refractive index detector (RI) measurement in measurement with a gel permeation chromatogram (GPC)- multi-angle laser light scattering detector (MALLS);

wherein a maximum height of peak (Hr2) in a molecular weight domain Dr2 ranging from 800,000 to 4,000,000 in the measurement of THF soluble matter of the toner with a gel permeation chromatogram (GPC)-differential refractive index detector (RI) satisfy the following expression (1) with respect to a height of a main peak (Hr1):

$$0.00 \leqq (Hr2)/(Hr1) \leqq 0.30 \quad (1)$$

wherein a maximum height peak (Hm2) in the molecular weight domain Dm2 ranging from 300,000 to 7,000,000 and a maximum height peak (Hm3) in a molecular weight domain Dm3 ranging from 7,000,000 to 20,000,000 in a gel permeation chromatogram (GPC)-differential refractive index detector (RI) measurement in a measurement of the toner with a gel permeation chromatogram (GPC) multi-angle laser light scattering detector (MALLS) satisfy the following expressions (3) and (4) with respect to a height of a main peak (Hm1) in the domain Dm1:

$$0.050 \leqq (Hm2)/(Hm1) < 0.500 \quad (3)$$

$$0.000 = (Hm3)/(Hm1) \quad (4);$$

wherein the toner particles are produced by granulating a polymerizable monomer composition containing styrene monomer, the colorant, the wax and an addition-reactive styrene resin having a double bond in an aqueous medium and polymerizing the resultant by suspension polymerization;

wherein the addition-reactive styrene resin having a double bond is a styrene-butyl acrylate copolymer having a double bond;

wherein the toner particles have an average circularity of 0.970 to 1.000;

wherein peaks in the addition-reactive styrene resin originating from the double bond are present in the range of 4.6 to 4.9 ppm and in the range of 5.0 to 5.2 pm in $^{1}$H-NMR measurement using a heavy chloroform solvent and the weight average molecular weight of the addition-reactive styrene resin is 2,000 to 6,000;

wherein an endothermic chart of the toner measured by differential scanning calorimetry (DSC) has an endothermic main peak in the range of 40 to 130° C.; and a heat quantity integration value Q represented by a peak area of the endothermic main peak is 10 to 35 J per 1 g of the toners; and wherein the wax is present in the toner particles in an amount of 2 to 30 mass %.

2. A toner according to claim 1, wherein the toner has a mode circularity of 0.98 or more to 1.00 or less.

3. A toner according to claim 1, wherein the ratio S1 : S2 : S3 among an integration value (Si) of a molecular weight domain ranging from 300 to 2,000, an integration value (S2) of a molecular weight domain ranging from 2,000 to 15,000, and an integration value (S3) of a molecular weight domain ranging from 15,000 to 1,000,000 in a molecular weight distribution of the THF soluble matter in the toner measured by GPC is (0.01 to 0.95): 1.00: (1.00 to 8.00).

4. A toner according to claim 1, further comprising a polyester resin.

5. A toner according to claim 4, wherein the polyester resin comprises a styrene-denatured polyester resin.

6. A toner according to claim 1, wherein the addition-reactive resin has a number average molecular weight of 500 or more to 3,000 or less.

* * * * *